US008720554B2

(12) United States Patent
Clapp et al.

(10) Patent No.: US 8,720,554 B2
(45) **Date of Patent: *May 13, 2014**

(54) APPARATUS AND METHODS OF FLOW TESTING FORMATION ZONES

(71) Applicant: Weatherford/Lamb, Inc., Houston, TX (US)

(72) Inventors: Timothy Dale Clapp, Lafayette, LA (US); Robert Murphy, Montgomery, TX (US); Paul James Wilson, Aledo, TX (US); Mark Rogers, Katy, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/649,846

(22) Filed: Oct. 11, 2012

(65) Prior Publication Data

US 2013/0092372 A1 Apr. 18, 2013

Related U.S. Application Data

(62) Division of application No. 12/030,154, filed on Feb. 12, 2008, now Pat. No. 8,286,703.

(60) Provisional application No. 60/889,501, filed on Feb. 12, 2007.

(51) Int. Cl.

| | |
|---|---|
| ***E21B 49/00*** | (2006.01) |
| ***E21B 33/124*** | (2006.01) |
| ***E21B 21/08*** | (2006.01) |

(52) U.S. Cl.

USPC ..... 166/250.17; 166/250.02; 166/250.01

(58) Field of Classification Search

USPC ..... 166/250.01, 250.02, 250.07, 250.17

See application file for complete search history.

(56) References Cited

U.S. PATENT DOCUMENTS

| | | | |
|---|---|---|---|
| 3,036,460 | A | 5/1962 | White et al. |
| 3,097,693 | A | 7/1963 | Terrel |
| 3,104,709 | A | 9/1963 | Kenneday et al. |
| 3,105,546 | A | 10/1963 | Ownby et al. |

(Continued)

FOREIGN PATENT DOCUMENTS

| | | | |
|---|---|---|---|
| EP | 0 697 501 | A2 | 2/1996 |
| EP | 1149980 | A2 | 10/2001 |
| GB | 2355033 | A | 4/2001 |

OTHER PUBLICATIONS

"Electronic Downhole Shut-In Tool," Weatherford Completion Systems, 2001.

(Continued)

*Primary Examiner* — Brad Harcourt

(74) *Attorney, Agent, or Firm* — Patterson & Sheridan, L.L.P.

(57) ABSTRACT

A method of flow testing multiple zones in a wellbore includes lowering a tool string into the wellbore. The tool string includes an inflatable packer or plug and an electric pump. The method further includes operating the pump, thereby inflating the packer or plug and isolating a first zone from one or more other zones; monitoring flow from the first zone; deflating the packer or plug; moving the tool string in the wellbore; and operating the pump, thereby inflating the packer or plug and isolating a second zone from one or more other zones; and monitoring flow from the second zone. The zones are monitored in one trip.

28 Claims, 21 Drawing Sheets

(56) References Cited

U.S. PATENT DOCUMENTS

| | | | |
|---|---|---|---|
| 3,294,163 | A | 12/1966 | Lebourg |
| 3,417,827 | A | 12/1968 | Smith et al. |
| 3,439,740 | A | 4/1969 | Conover |
| 3,704,749 | A | 12/1972 | Estes et al. |
| 3,964,553 | A | 6/1976 | Basham et al. |
| 4,082,298 | A | 4/1978 | Sanford |
| 4,410,051 | A | 10/1983 | Daniel et al. |
| 4,424,860 | A | 1/1984 | McGill |
| 4,476,923 | A | 10/1984 | Walling |
| 4,492,383 | A | 1/1985 | Wood |
| 4,635,717 | A | 1/1987 | Jageler |
| 4,849,699 | A | 7/1989 | Gill et al. |
| 4,852,648 | A | 8/1989 | Akkerman et al. |
| 4,898,236 | A | 2/1990 | Sask |
| 4,901,069 | A | 2/1990 | Veneruso |
| 4,916,617 | A | 4/1990 | Norwood |
| 5,018,574 | A | 5/1991 | Smith |
| 5,095,983 | A | 3/1992 | Magnani |
| 5,146,983 | A | 9/1992 | Hromas et al. |
| 5,207,272 | A | 5/1993 | Pringle et al. |
| 5,236,048 | A | 8/1993 | Skinner et al. |
| 5,297,633 | A | 3/1994 | Snider et al. |
| 5,320,182 | A | 6/1994 | Mendez |
| 5,337,821 | A | 8/1994 | Peterson |
| 5,343,963 | A | 9/1994 | Bouldin et al. |
| 5,375,658 | A | 12/1994 | Schultz et al. |
| 5,404,946 | A | 4/1995 | Hess |
| 5,492,173 | A | 2/1996 | Kilgore et al. |
| 5,495,892 | A | 3/1996 | Carisella |
| 5,555,220 | A | 9/1996 | Minto |
| 5,555,945 | A | 9/1996 | Schultz et al. |
| 5,577,560 | A | 11/1996 | Coronado et al. |
| 5,582,248 | A | 12/1996 | Estes |
| 5,587,707 | A | 12/1996 | Dickie et al. |
| 5,700,968 | A | 12/1997 | Blimke |
| 5,868,201 | A | 2/1999 | Bussear et al. |
| 6,055,213 | A | 4/2000 | Rubbo et al. |
| 6,076,268 | A | 6/2000 | Fuhr |
| 6,105,690 | A | 8/2000 | Biglin, Jr. et al. |
| 6,223,820 | B1 | 5/2001 | Carisella |
| 6,223,821 | B1 | 5/2001 | Coronado |
| 6,305,477 | B1 | 10/2001 | Carisella et al. |
| 6,341,654 | B1 | 1/2002 | Wilson et al. |
| 6,367,545 | B1 | 4/2002 | Van Buskirk et al. |
| 6,378,607 | B1 | 4/2002 | Ryan et al. |
| 6,389,890 | B1 | 5/2002 | Sweetland et al. |
| 6,394,184 | B2 | 5/2002 | Tolman et al. |
| 6,469,635 | B1 | 10/2002 | Hudson |
| 6,540,019 | B2 | 4/2003 | Willauer |
| 6,601,461 | B2 | 8/2003 | Maxit et al. |
| 6,622,554 | B2 | 9/2003 | Manke et al. |
| 6,655,460 | B2 | 12/2003 | Bailey et al. |
| 6,729,398 | B2 | 5/2004 | Ringgenberg et al. |
| 6,779,601 | B2 | 8/2004 | Wilson et al. |
| 6,820,693 | B2 | 11/2004 | Hales et al. |
| 6,886,631 | B2 | 5/2005 | Wilson et al. |
| 6,945,330 | B2 | 9/2005 | Wilson et al. |
| 7,073,580 | B2 | 7/2006 | Wilson et al. |
| 7,152,680 | B2 | 12/2006 | Wilson et al. |
| 7,191,844 | B2 | 3/2007 | Kenison et al. |
| 7,216,703 | B2 | 5/2007 | Smith |
| 7,543,635 | B2 | 6/2009 | East et al. |
| 7,827,859 | B2 | 11/2010 | Pipchuk et al. |
| 8,286,703 | B2 * | 10/2012 | Clapp et al. ..... 166/250.17 |
| 2001/0032721 | A1 | 10/2001 | Rider et al. |
| 2002/0007949 | A1 | 1/2002 | Tolman et al. |
| 2002/0066563 | A1 * | 6/2002 | Langseth et al. ..... 166/264 |
| 2003/0010135 | A1 | 1/2003 | Maxit et al. |
| 2003/0098157 | A1 | 5/2003 | Hales et al. |
| 2003/0155120 | A1 | 8/2003 | Richards et al. |
| 2003/0188862 | A1 | 10/2003 | Streich et al. |
| 2004/0003657 | A1 | 1/2004 | Manke et al. |
| 2004/0020709 | A1 | 2/2004 | Wilson et al. |
| 2004/0035199 | A1 | 2/2004 | Meister et al. |
| 2004/0108108 | A1 | 6/2004 | Bailey et al. |
| 2005/0126791 | A1 | 6/2005 | Barbee et al. |
| 2005/0150661 | A1 | 7/2005 | Kenison et al. |
| 2005/0211433 | A1 | 9/2005 | Wilson et al. |
| 2005/0269106 | A1 | 12/2005 | Wilson et al. |
| 2006/0081380 | A1 | 4/2006 | Hoffman et al. |
| 2006/0090905 | A1 | 5/2006 | Brennan et al. |
| 2006/0102342 | A1 | 5/2006 | East et al. |
| 2007/0044960 | A1 | 3/2007 | Lovell et al. |

OTHER PUBLICATIONS

"Inflatable Retrievable Production Packer (IRPP)," Weatherford Isolation Solutions, 2005, p. 109.

"Flow Rate Tester (FRT) Sensor," Weatherford International Ltd., 2006.

* cited by examiner

APPARATUS AND METHODS OF FLOW TESTING FORMATION ZONES

BACKGROUND OF THE INVENTION

1. Field of the Invention

Embodiments of the present invention generally relate to apparatus and methods of flow testing formation zones.

2. Description of the Related Art

In the drilling of oil and gas wells, a wellbore is formed using a drill bit that is urged downwardly at a lower end of a drill string. After drilling a predetermined depth, the drill string and bit are removed, and the wellbore is lined with one or more strings of casing or a string of casing and one or more strings of liner. An annular area is thus formed between the string of casing/liner and the formation. A cementing operation is then conducted in order to fill the annular area with cement. The combination of cement and casing/liner strengthens the wellbore and facilitates the isolation of certain areas of the formation behind the casing for the production of hydrocarbons.

After a well has been drilled and completed, it is desirable to provide a flow path for hydrocarbons from the surrounding formation into the newly formed wellbore. To accomplish this, perforations are shot through the casing/liner string at a depth which equates to the anticipated depth of hydrocarbons. Alternatively, the casing/liner may include sections with preformed holes or slots or may include sections of sand exclusion screens. Zonal isolation may be achieved using external packers instead of cement.

When a wellbore is completed, the wellbore is opened for production. In some instances, a string of production tubing is run into the wellbore to facilitate the flow of hydrocarbons to the surface. In this instance, it is common to deploy one or more packers in order to seal the annular region defined between the tubing and the surrounding string of casing. In this way, a producing zone within the wellbore is isolated.

Subterranean well tests are commonly performed to determine the production potential of a zone of interest. The test usually involves isolating the zone of interest and producing hydrocarbons from that zone. The amount of hydrocarbon produced provides an indication of the profitability of that zone.

Formation testing generally involves isolating the zone(s) of interest using a packer (or a plug). The packer is lowered to the target depth and actuated to seal against the wellbore, thereby isolating the zone to be tested. To arrive at the zone of interest, the packer is usually run through the production tubing string and then expanded against the wellbore. The ID of the production tubing is usually substantially smaller than the ID of the wellbore through the formation. This ID discrepancy requires packers having high expansion ratios which are typically inflatable packers.

These inflatable packers typically include an inflatable elastomeric bladder concentrically disposed around a central body portion such as a tube or mandrel. A sheath of reinforcing slats or ribs may be concentrically disposed around the bladder and a thick-walled elastomeric packing cover is concentrically disposed around at least a central portion of the sheath. The inflatable packers may be deployed in a wellbore using slickline, coiled tubing, threaded pipe, or wireline.

Pressurized fluid is pumped into the bladder to expand the bladder and the ribs outwardly into contact with the wellbore. A valve such as a poppet valve may be used to maintain the packer in an inflated state. After the packer is sufficiently expanded to seal the wellbore, the coiled tubing, jointed pipe, or wireline is detached from the packer and is retrieved from the wellbore. The inflated packer remains to operate as a seal.

To test multiple zones, a separate trip into the wellbore is performed to retrieve the packer and set a new one. The process of re-entering the wellbore and setting a new packer increases the time and effort of the operation.

There is a need, therefore, for apparatus and methods of testing multiple zones in one trip.

SUMMARY OF THE INVENTION

Embodiments of the present invention provide a method and apparatus for flow testing multiple zones in a single trip. In one embodiment, a method of flow testing multiple zones in a wellbore includes lowering a tool string into the wellbore. The tool string includes an inflatable packer or plug and an electric pump. The method further includes operating the pump, thereby inflating the packer or plug and isolating a first zone from one or more other zones; monitoring flow from the first zone; deflating the packer or plug; moving the tool string in the wellbore; and operating the pump, thereby inflating the packer or plug and isolating a second zone from one or more other zones; and monitoring flow from the second zone. The zones are monitored in one trip.

In another embodiment, a tool string for use in a wellbore includes an inflatable packer or plug; an electric pump operable to inflate the packer or plug; and a deflation tool operable to deflate the packer or plug in an open position. The deflation tool is repeatably operable between the open position and a closed position and the tool string is tubular.

In another embodiment, a method of flow testing multiple zones in a wellbore includes lowering a tool string into the wellbore. The tool string includes a plurality of inflatable packers and/or plugs and a flow meter. The method further includes inflating the packers and/or plugs, thereby straddling a first zone; monitoring flow from the first zone using the flow meter; deflating the packer or plug; moving the tool string in the wellbore; inflating the packer and/or plugs, thereby straddling a second zone; and monitoring flow from the second zone using the flow meter. The zones are monitored in one trip.

In another embodiment, a method of flow testing multiple zones in a wellbore includes lowering a tool string into the wellbore. The tool string includes a plurality of inflatable packers. The method further includes inflating the packers, thereby straddling a first zone. The method further includes, while the first zone is straddled, monitoring flow from the first zone; and monitoring flow from a second zone located between a lower packer and the bottom of the wellbore.

BRIEF DESCRIPTION OF THE DRAWINGS

So that the manner in which the above recited features of the present invention, and other features contemplated and claimed herein, are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
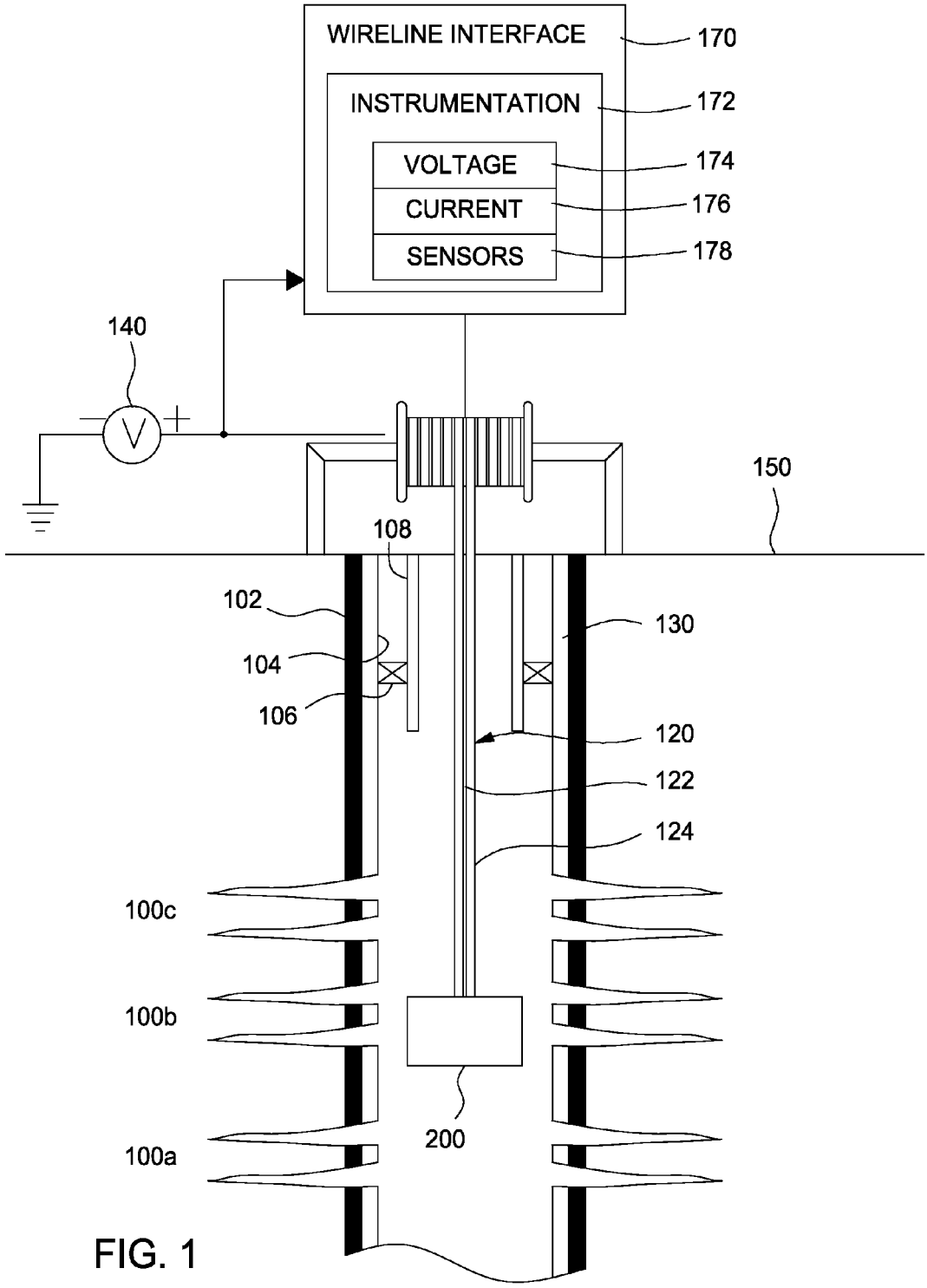
FIG. 1 illustrates a tool string deployed into a wellbore, according to one embodiment of the present invention.

FIG. 1 illustrates a tool string 200 deployed into a wellbore 130, according to one embodiment of the present invention. The tool assembly 200 is lowered down the wellbore 130 on a wireline 120 having one or more electrically conductive wires 122 surrounded by an insulative jacket 124. Alternatively, slickline, coiled tubing, optical cable, or continuous sucker rod such as COROD® may be used instead of the wireline 120. The wellbore 130 has been lined with casing 104 cemented 102 in place. Production tubing 108 may extend from the surface 150 and a packer 106 may seal the casing/tubing annulus. The wellbore has been drilled through a formation and one or more zones 100*a-c* have been perforated. As shown, the casing 104 extends into the formation. Alternatively, a liner or sand screen may be hung from the casing 104.

A wireline interface 170 may include instrumentation 172 to provide the operator with feedback while operating the inflation tool 300. For example, the instrumentation 172 may include a voltage instrument 174 and a current instrument 176 to provide an indication of the voltage applied to the wireline 120 and the current draw of the inflation tool 300, respectively. The voltage and current draw of the inflation tool 300 may provide an indication of a state of the inflation tool 300. For example, a current draw of the inflation tool 300 may be proportional to a setting pressure of the inflatable plug 600. The instrumentation 172 may include any combination of analog and digital instruments and may include a display screen similar to that of an oscilloscope, for example to allow an operator to view graphs of the voltage signal applied to the wireline 120.

Figure 2:
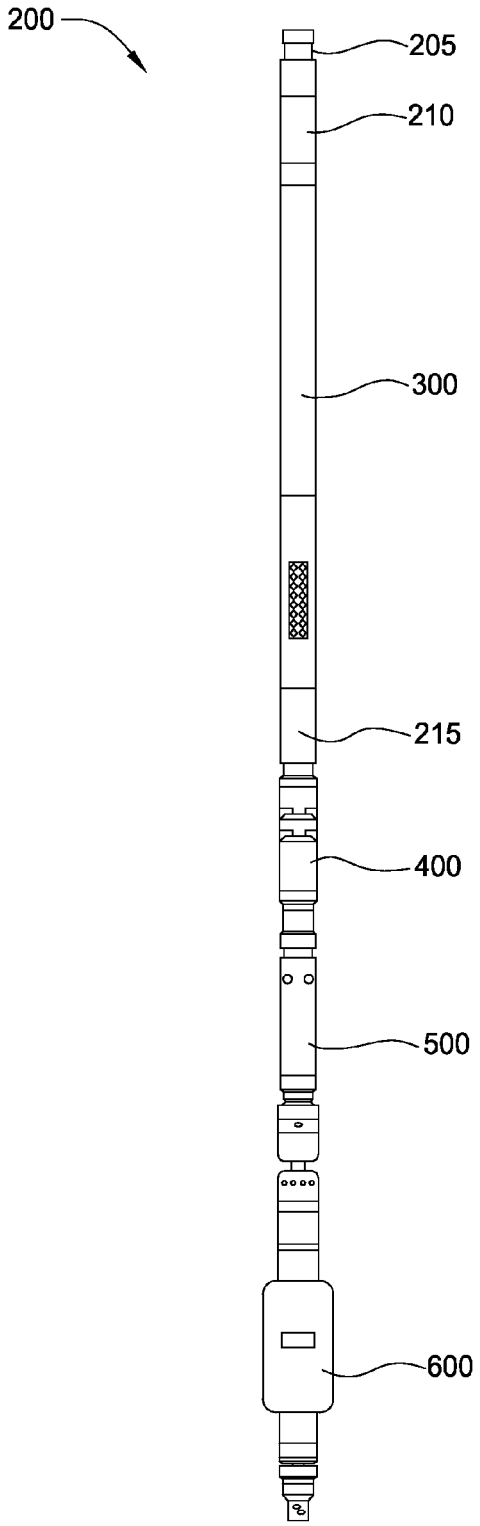
FIG. 2 illustrates the tool string.
Figure 3A:
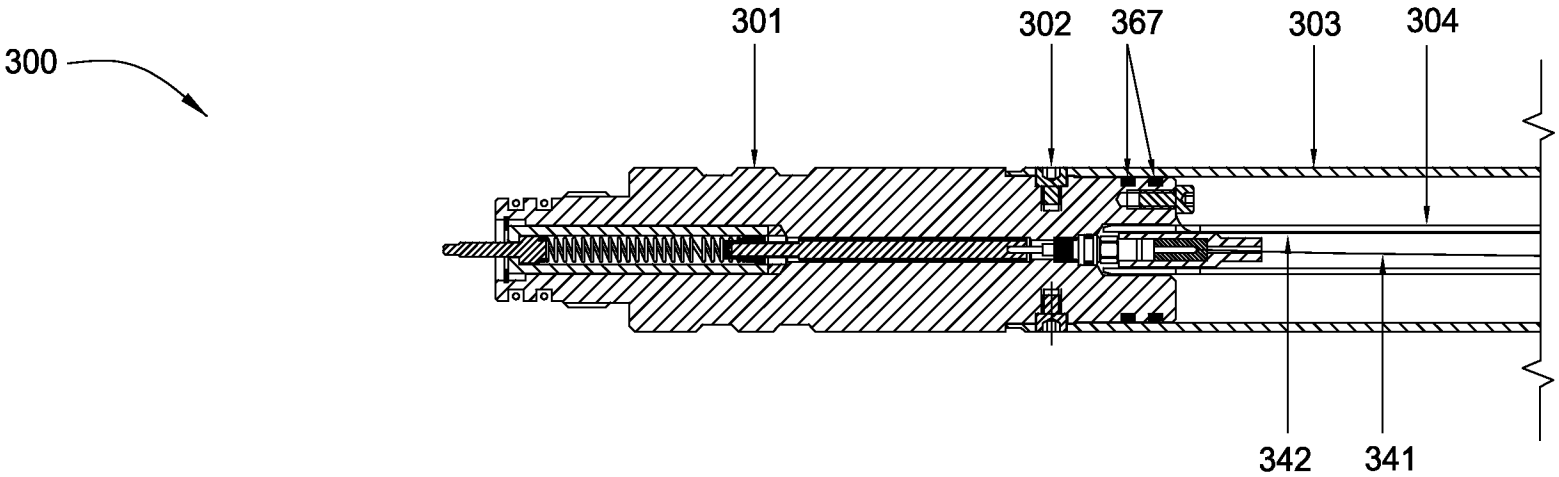
FIGS. 3A-3K illustrate an inflation tool suitable for use with the tool string.
Figure 3B:
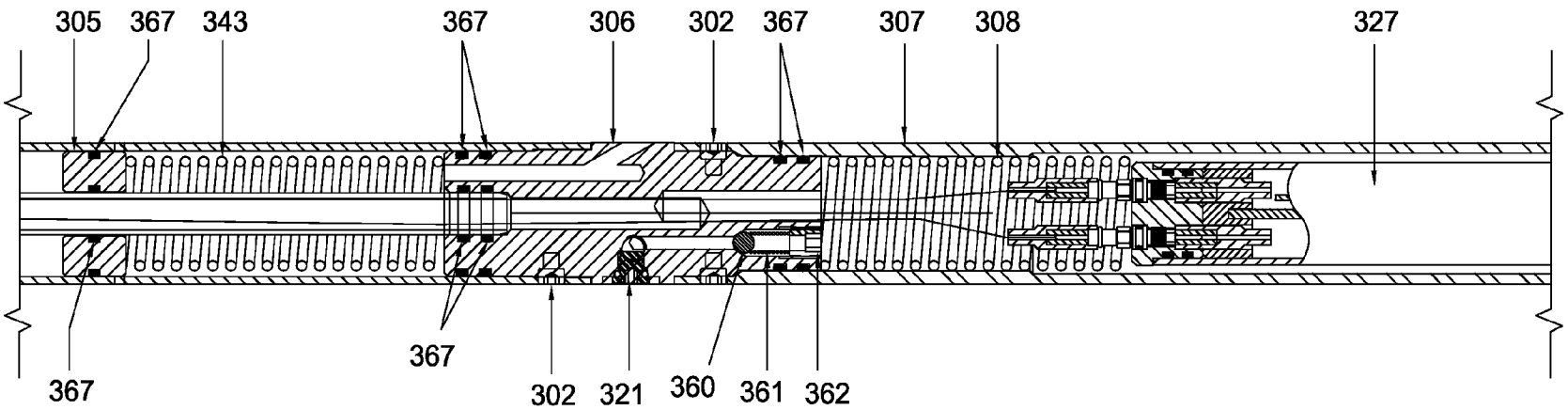
Figure 3C:
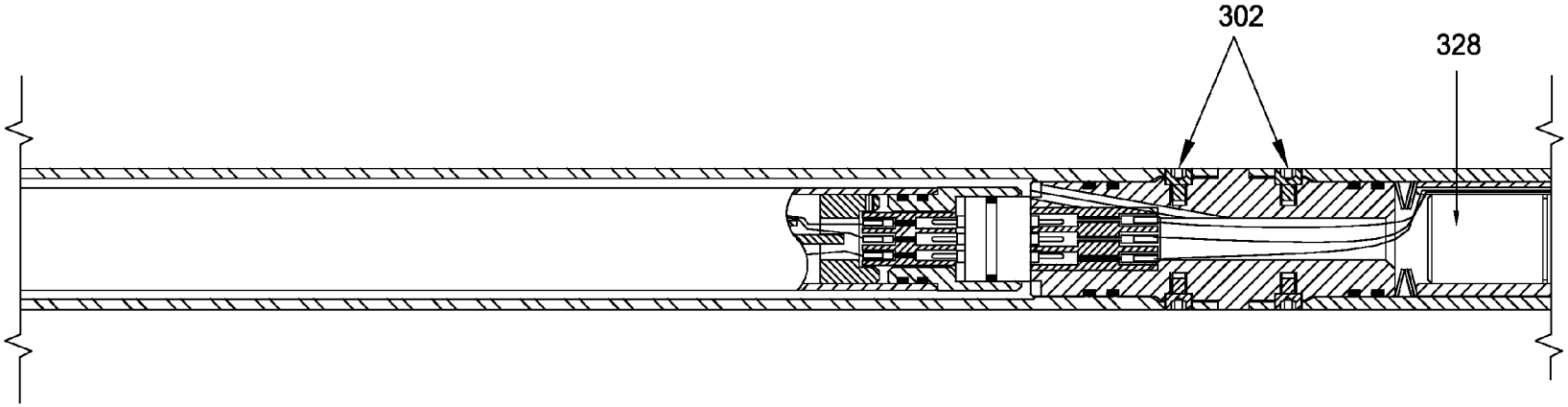
Figure 3D:
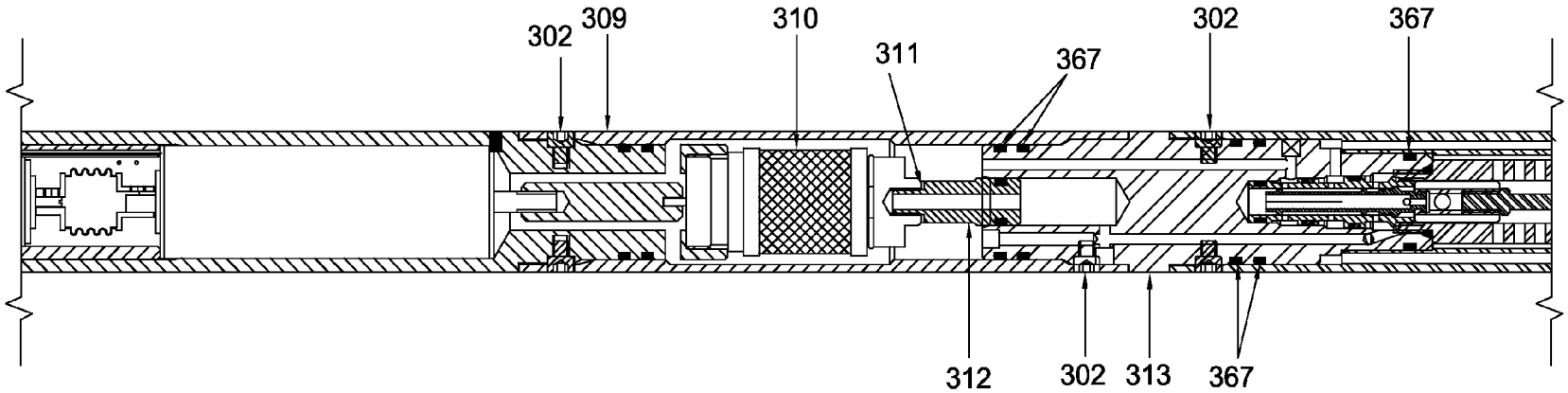
Figure 3E:
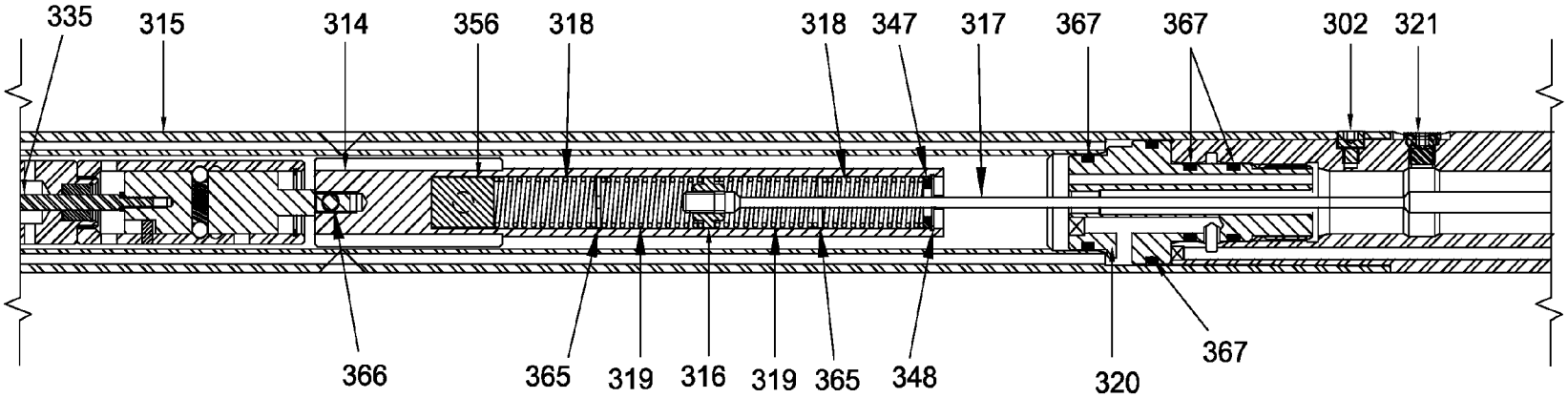
Figure 3F:
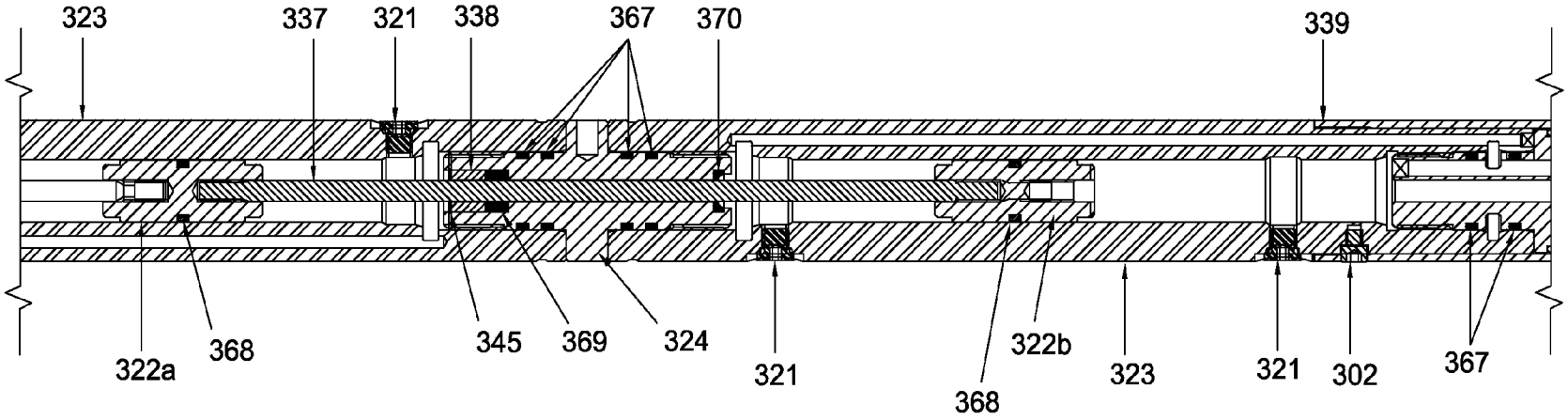
Figure 3G:
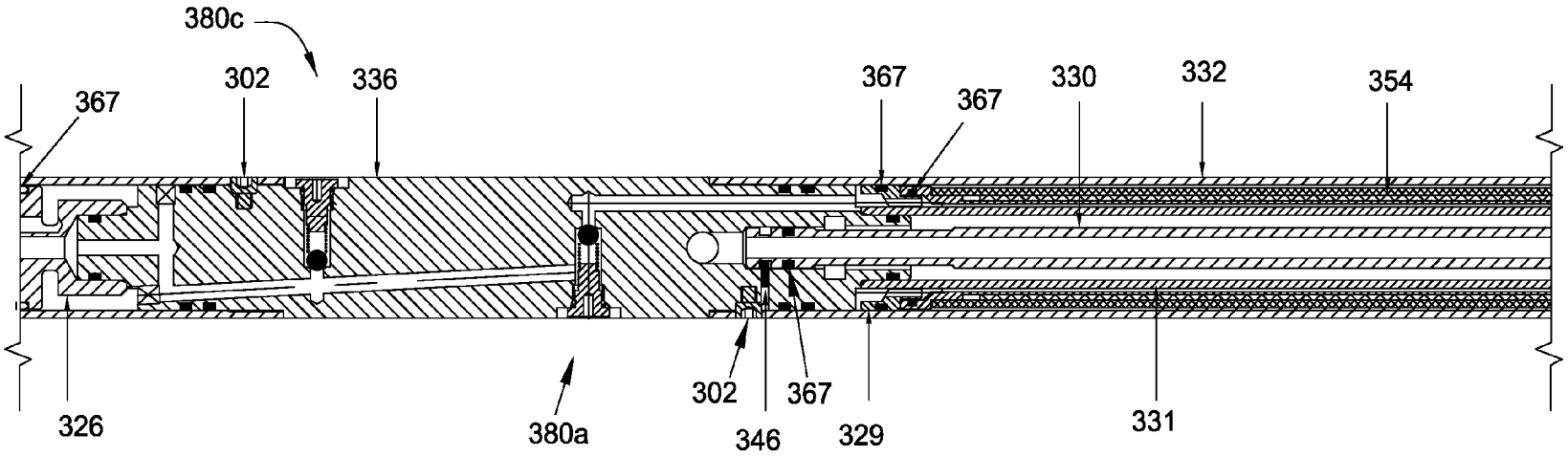
Figure 3H:
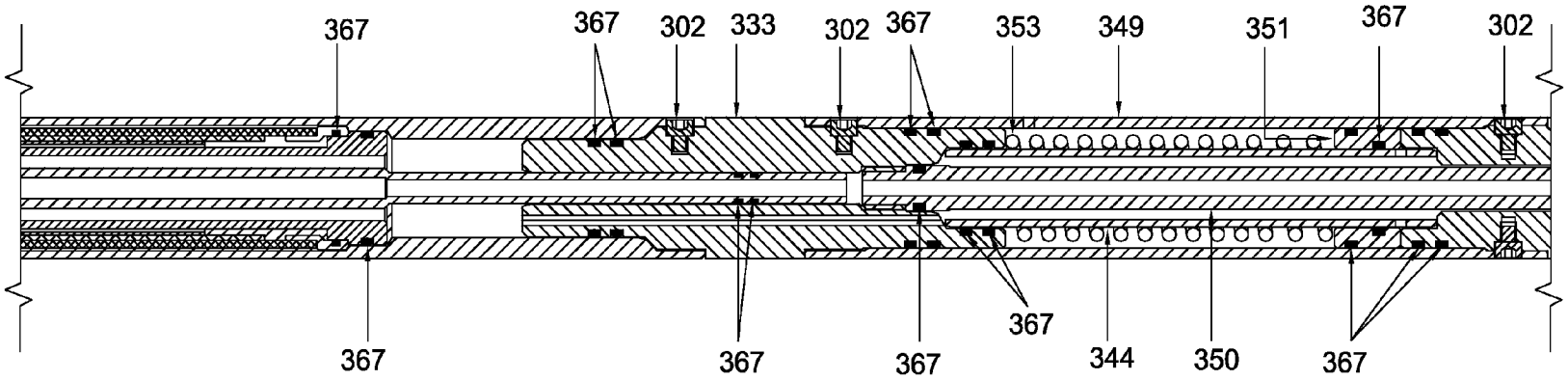
Figure 3I:
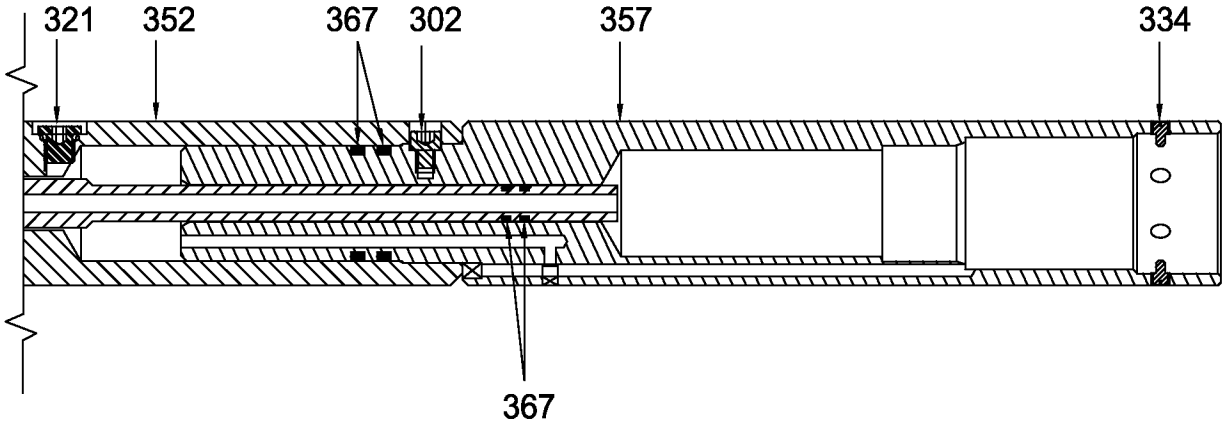
Figure 3J:
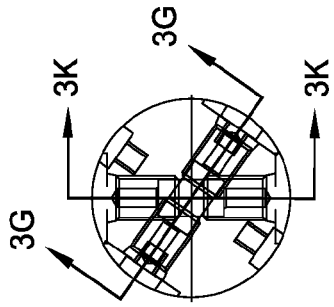
Figure 3K:
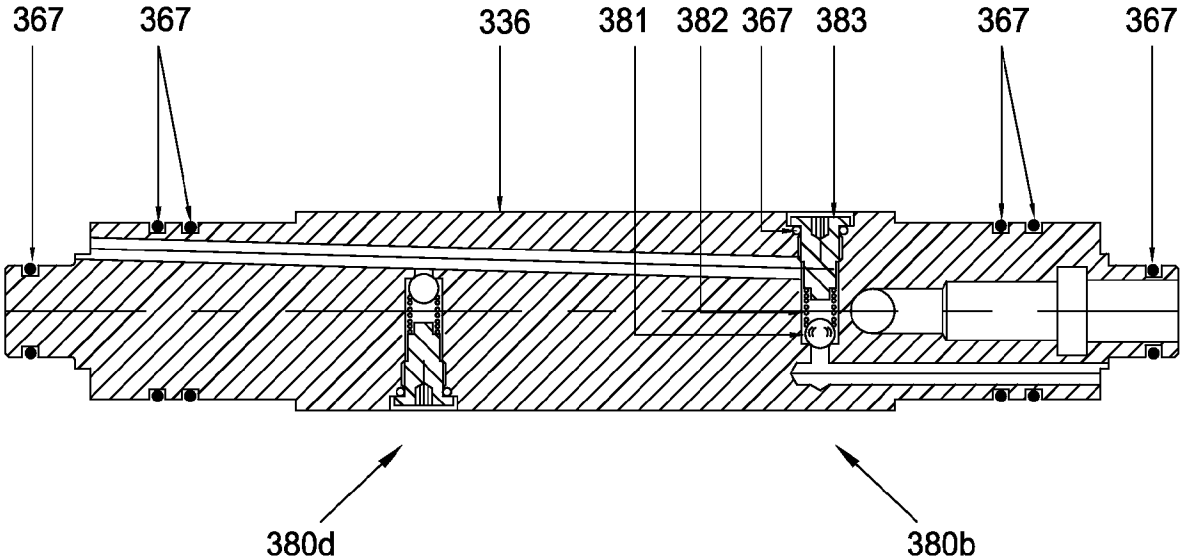

FIG. 2 illustrates the tool string 200. The tool string 200 may include an inflation tool 300, an adapter 215, a check or one-way valve 400, a deflation tool 500, and an inflatable plug 600. A cable head 205 may connect the assembly 200 to the wireline 120 and provide electrical and mechanical connectivity to subsequent tools of the assembly 200, such as a collar locator 210 and the inflation tool 300. The collar locator 210 may be a passive tool that generates an electrical pulse when passing variations in pipe wall, such as a collar of a casing 104 within the wellbore 130. Alternatively or additionally, a gamma-ray tool may be used to determine depth by correlating formation data with wellbore depths. Alternatively or additionally, a depth of the string 200 may be determined by simply monitoring a length of wireline 120 while lowering the string 200. The adapter 215 may be used to couple the inflation tool 300 to the one-way valve 400. In one embodiment, the adapter 215 is a crossover sub having a fluid passage for fluid communication between the inflation tool 300 and the inflatable plug 600.

The inflation tool 300 may be a single or multi-stage downhole pump capable of drawing in wellbore fluid, filtering the fluids, and injecting the filtered fluids into the inflatable plug 600. The inflation tool may be a positive displacement pump, such as a reciprocating piston, or a turbomachine, such as a centrifugal, axial flow, or mixed flow pump. The inflation tool 300 may be operated via electricity supplied down the wires 122 of the wireline 120 from a power supply 140 at a surface 150 of the wellbore 130. The inflation tool 300 is operated at a voltage set by an operator at the surface 150. For example, the inflation tool 300 may be operated at 120 VDC. However, the operator may set a voltage at the surface 150 above 120 VDC (i.e. 160 VDC) to allow for voltage loss due to impedance in the electrically conductive wires 122. If coiled tubing is used instead of wireline, the inflation tool 300 may be omitted as fluid may be injected from the surface through the coiled tubing to inflate the plug 600.

FIGS. 3A-3K illustrate an inflation tool 300 suitable for use with the tool string 200. The inflation tool 300 may include a collar locator crossover 301, a plurality of screws 302, a pressure balanced chamber housing 303, a conductor tube 304, a pressure balance piston 305, a fill port sub 306, a controller housing 307, a spring 308, a pump housing 309, a working fluid pump 310, a pump washer 311, a pump adaptor 312, a control valve bulkhead 313, a spring coupler 314, a detent housing 315, a disc 316, a control rod 317, a plurality of heavy springs 318, a plurality of light springs 319, a top bulkhead 320, a plurality of plugs 321, a drive piston 322*a*, a pump piston 322*b*, a plurality of ported hydraulic cylinders 323, a middle bulkhead 324, a bottom bulkhead 326, a controller 327, an electric motor 328, a filter support ring 329, a vent tube 330, a filter support tube 331, a filter housing 332, a vent crossover 333, a plurality of shear screws 334, a directional valve 335, a check valve assembly 336, a drive shaft 337, a bushing seal 338, a cylinder housing 339, a ground wire assembly 341, a lead wire assembly 342, a spring 343, an output tube 344, a retaining ring 345, a plurality of set screws 346, a spring bushing 347, a ring 348, a vent housing 349, a vent extension 350, a vent piston 351, a socket sub 352, a spring 353, a filter 354, a spacer 356, a crossover 357, a ball 360, a spring 361, a nozzle 362, a washer 365, a set screw 366, a plurality of O-rings 367, a T-seal 368, a seal stack 369, and a wiper 370. The check valve assembly 336 may include a plurality of check valves 380*a-d*. Each check valve may include a check ball 381, a spring 382, and a plug 383.

As shown, the inflation tool 300 may be an electro-hydraulic pump. The middle bulkhead 324 fluidly isolates a working fluid portion of the pump 300 from a wellbore fluid portion of the pump. The working fluid portion is filled prior to insertion of the pump 300 in the wellbore 130. The working fluid may be a clean liquid, such as oil. The working fluid portion of the pump is a closed system. The electric motor 328 receives electricity from the wireline 120 and drives the working fluid pump 310. The working fluid pump 310 pressurizes the working fluid which drives the drive piston 322*a*. The drive piston 322*a* is reciprocated by the directional valve 335 alternately providing fluid communication between each longitudinal end of the drive piston 322*a* and the pressurized working fluid. The drive piston 322*a* is longitudinally coupled to the pump piston 322*b*. The check valve assembly 336 includes the inlet check valve 380*a, b* and the outlet check valve 380*c, d* for each longitudinal end of the pump piston 322*b*. The inlet check valves are in fluid communication with an outlet of the filter 354. Wellbore fluid is drawn in through one or more inlet ports (see FIG. 2) of the filter 354. Solid particulates are filtered from the wellbore fluid as it passes through the filter. Filtered wellbore fluid is output from the filter to the inlet check valves. Pressurized filtered wellbore fluid is driven from the pump piston to the outlet check valves. The outlet check valves are in fluid communication with the vent tube 330. Pressurized filtered wellbore fluid travels through the vent tube 330 and the vent extension 350 to the crossover 357. The pressurized filtered wellbore fluid continues through the string 200 until it reaches the plug 600.

The pressure balance piston 305 maintains a working fluid reservoir at wellbore pressure. The pump 300 may also be temperature compensated. The vent piston 351 allows for the pump 300 to operate in a closed system or in cross-flow.

Alternatively, the inflation tool 300 may be the inflatable packer setting tool disclosed in U.S. Pat. No. 6,341,654, issued to Wilson et al. and assigned to Weatherford/Lamb, Inc. of Houston, Tex., which patent is herein incorporated by reference in its entirety. This alternative inflatable packer setting tool assembly includes a fluid supply housing and a setting tool that is releasably interconnected to an inflatable packer. The setting tool further includes a pump that is fluidly interconnected with the inflatable packer and is operable to inflate the inflatable packer. The fluid supply housing is fluidly interconnected with the setting tool and includes an inflation fluid passageway that has an inlet and outlet which is fluidly interconnected with a suction side of the pump. The inlet is in the form of an aperture on an outer wall of the supply housing and functions to fluidly interconnect the passageway to a source of first inflation fluid present in the well bore when the setting tool assembly is lowered into the well bore. Further, a filter housing is situated in the supply housing so that the second inflation fluid must pass through the filter housing prior to passing through the inflation fluid passageway. The supply housing also includes a reservoir for containing a second inflation fluid, such as a water-soluble oil. The reservoir includes a spring-loaded movable piston that allows for the volume in the reservoir to vary (e.g., due to thermal expansion of the second inflation fluid). An outlet of the reservoir is fluidly interconnected with the inflation fluid passageway. Thus, the setting tool (i.e., the pump) is operable to draw first and second inflation fluids from the supply housing and to deliver a mixture of the first and second inflation fluids to the inflatable packer so as to inflate inflatable packer.

In yet another embodiment, the inflation tool may employ a high volume-low pressure (HV-LP) pump in combination with a low volume-high pressure (LV-HP) pump to inflate the inflatable plug. Such a pump combination is disclosed in U.S. Pat. No. 6,945,330, issued to Wilson et al. and assigned to Weatherford/Lamb, Inc. of Houston, Tex., which patent is herein incorporated by reference in its entirety. In use, the HV-LP may initially inflate the plug 600 at a high rate until additional pressure is necessary to exert a sealing force against the casing. At that time, the LV-HP pump is actuated to supply inflation fluid at a higher pressure to seal the inflatable element against the casing. In another embodiment, the tool assembly may include a fluid reservoir such that inflation tool may draw fluid from the attached fluid reservoir instead of the wellbore to inflate the inflatable element.

Figure 4:
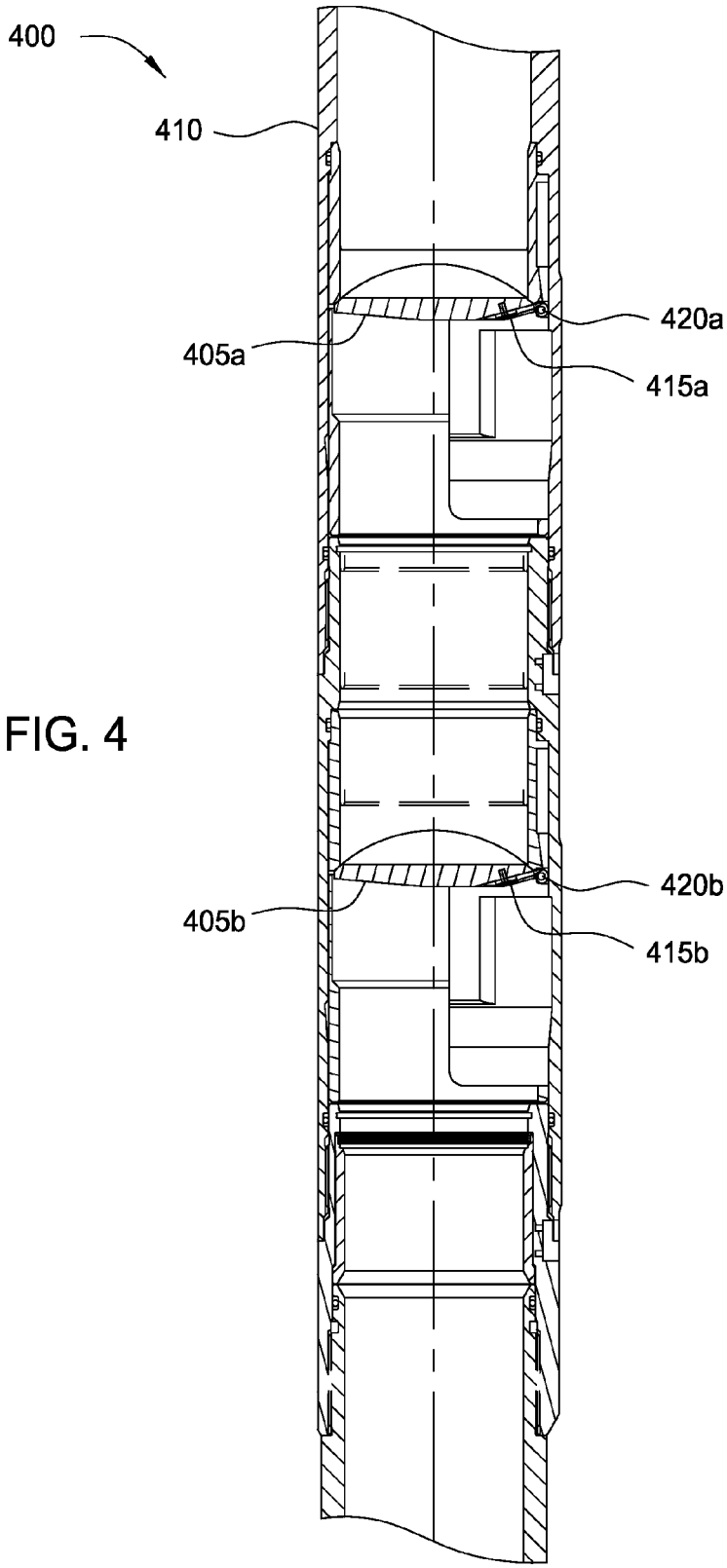
FIG. 4 is a cross section of a suitable one-way valve.

FIG. 4 is a cross section of a suitable one-way valve 400. The one-way valve 400 is adapted maintain inflation of the inflatable plug 600. In this respect one-way valve 400 allows fluid to be pumped from the inflation tool 300 toward the inflatable plug 600 for inflation thereof, while preventing backflow of the pumped fluid from the inflatable plug 600. The one-way valve 400 includes one or more valve elements, such as flappers 405*a, b*. Alternatively, a ball biased to engage a seat may be used instead of the flapper. Each flapper is biased toward a closed position by a respective spring 415*a, b*. Each flapper is pivoted to a housing 410 by a respective pin 415*a, b*. The housing may include one or more tubulars. Each of the tubulars may be connected by threaded connections. The dual valve elements 405*a, b* provide for redundancy in the event one of failure of one of the valve elements. Alternatively, the one-way valve may be integrated with the outlet of the inflation tool 300, thereby eliminating the need of a separate valve sub connection. If the inflation tool 300 includes an integral check valve, then the one-way valve 400 may be omitted.

Figure 5:
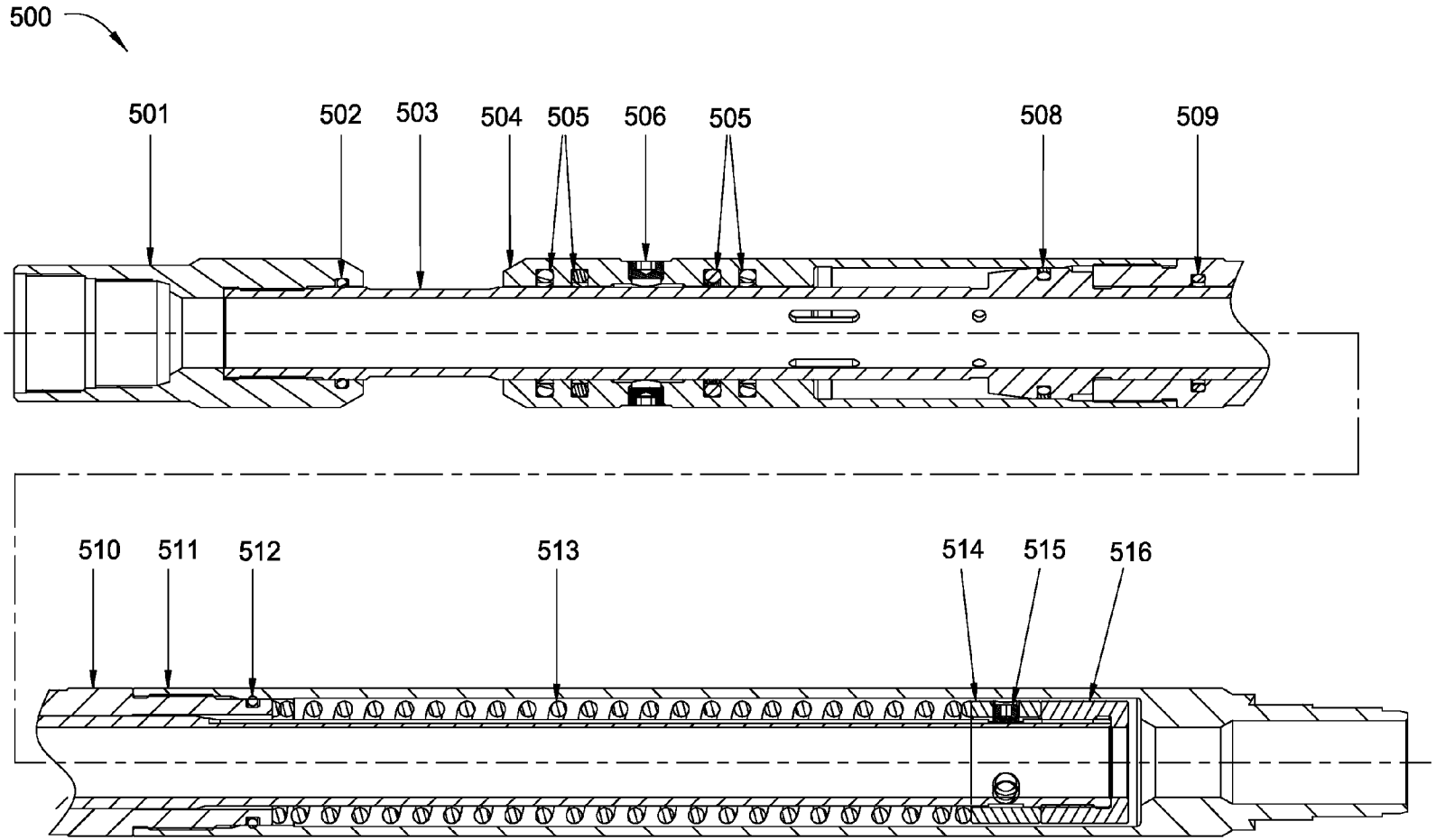
FIG. 5 is a cross section of a suitable deflation tool, such as a pickup-unloader.

FIG. 5 is a cross section of a suitable deflation tool, such as a pickup-unloader 500. When operated by applying a tensile force to the wireline 120 (picking up), the deflation tool 500 relieves the fluid in the inflatable plug/packer 600. Application of compression force (slacking off) will close the deflation tool 500. The deflation tool 500 includes a tubular mandrel 503 having a longitudinal flow bore therethrough. A top sub 501 is connected to the mandrel 503 and a seal, such as an O-ring, isolates the connection. The top sub connects to the check valve 400. A tubular case assembly including an upper case 504, a nipple 510, and a lower case 511 is disposed around the mandrel and longitudinally movable relative thereto. Seals, such as o-rings 508, 509, and 512 or other suitable seals, isolate the case assembly connections. A biasing member, such as a spring 513, is disposed between a ring 514 which abuts a nut 516 longitudinally coupled to the mandrel 503 and a longitudinal end of the nipple 510. The ring may also be secured with one or more set screws 515. The spring 513 biases the deflation tool toward a closed position (as shown).

In the closed position, one or more ports, such as slots, formed through the upper case 506 are isolated from one or more ports, such as slots, formed through the mandrel. A nozzle 506 may be disposed in each of the upper case ports. Seals, such as o-rings 505, isolate the upper case ports from an exterior of the deflation tool 500 and from the mandrel ports. When operated to an open position, a tensile force exerted on the wireline 120 pulls the mandrel flow ports into alignment with the upper case ports while overcoming the biasing the force of the spring until a shoulder of the mandrel engages a shoulder of the upper case 504. This allows the pressurized fluid stored in the inflated packer to be discharged into the wellbore, thereby deflating the packer. Slacking off of the wireline allows the spring to return the mandrel to the closed position where the mandrel shoulder engages a longitudinal end of the nipple.

Figure 6A:
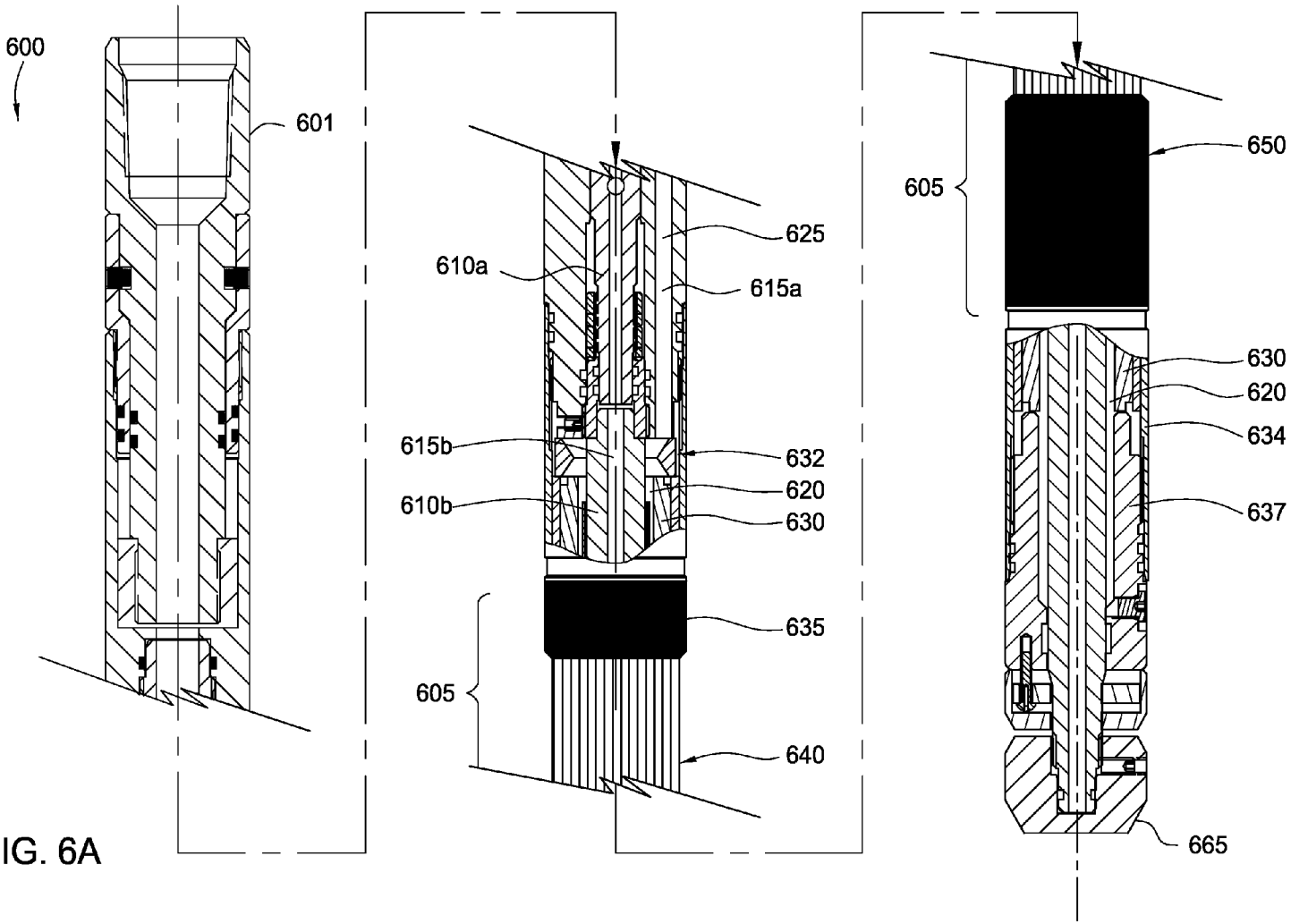
FIG. 6A is a partial section of a plug suitable for use with the tool string.
Figure 6B:
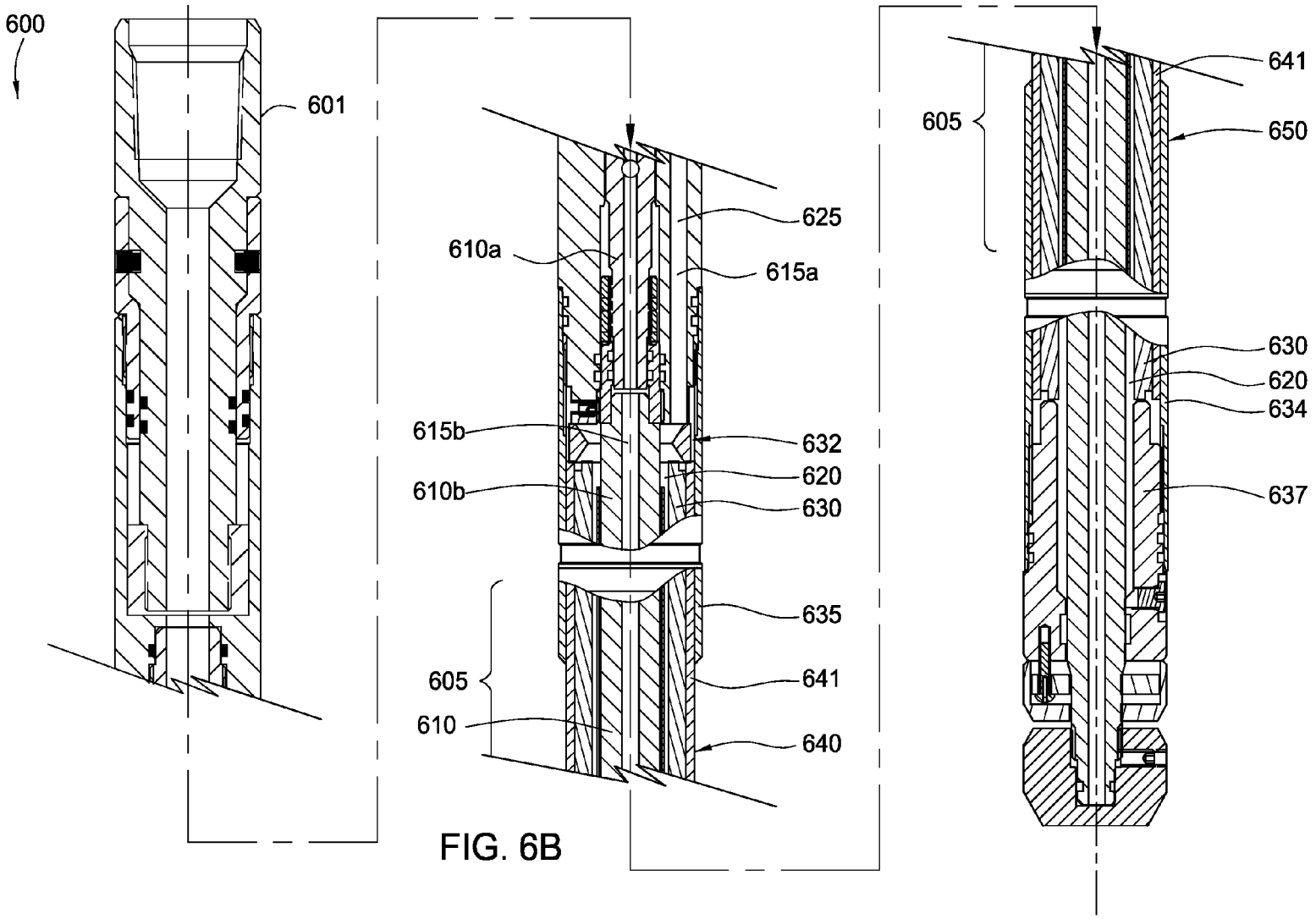
FIG. 6B is a cross section of the plug.

FIG. 6A is a partial section of a plug 600 suitable for use with the tool string 200. FIG. 6B is a cross section of the plug 600. The plug 600 includes a packing element 605. The packing element 605 may be inflated using wellbore fluids, or transported inflation fluids, via the inflation tool 300. When the packing element 605 is filled with fluids, it expands and conforms to a shape and size of the casing.

The plug 600 includes a crossover mandrel 610*a* and a plug mandrel 610*b*. The crossover mandrel 610*a* defines a tubular body having a bore 615*a* formed therethrough. The plug mandrel 610*b* defines a tubular body which runs the length of the packing element 605. A bore 615*b* is defined within the plug mandrel 610*b*. Further, an annular region 620 is defined by the space between the outer wall of the plug mandrel 610*b* and the surrounding packing element 605. The annular region 620 of the packing element 600 receives fluid from an upper annular region 625 of the plug 600 when the packing element 605 is actuated. This serves as the mechanism for expanding the packing element 605 into a set position within the casing.

To expand the packing element 605, fluid is injected by the inflation tool 300, through bore of a top sub 601, through a bore of the crossover mandrel 610*a*, through a port formed through a wall of the crossover mandrel, through the upper annular region 625, and into the annulus 621 of the packing element 600. Fluid continues to flow downward through the plug 600 until it is blocked at a lower end by a nose 665.

The packing element 605 includes an elongated bladder 630. The bladder 630 is disposed circumferentially around the plug mandrel 610*b*. The bladder 630 may be fabricated from a pliable material, such as a polymer, such as an elastomer. The bladder 630 is connected at opposite ends to end connectors 632 and 634. The upper end connector 632 may be a fixed ring, meaning that the upper end of the packing element 600 is stationary with respect to the packing element 200. The lower end connector 634 is connected to a slidable sub 637. The slidable sub 637, in turn, is movable along the plug mandrel 610*b*. This permits the bladder 630 and other packing element 600 parts to freely expand outwardly in response to the injection of fluid into the annular region 620 between the plug mandrel 610*b* and the bladder 630. In this view, the lower end connector 634 has moved upward along the plug mandrel 610*b*, thereby allowing the packing element 600 to be inflated.

The packing element 605 may further include an anchor portion 640. Alternatively, an anchor may be formed as a separate component. The anchor portion 640 may be fabricated from a series of reinforcing straps 641 that are disposed around the bladder 630. The straps 641 may be longitudinally oriented so as to extend at least a portion of the length of or essentially the length of the packing element 600. At the same time, the straps 641 are placed circumferentially around the bladder 630 in a tightly overlapping fashion. The straps 641 may be fabricated from a metal or alloy. Alternatively, other materials suitable for engaging the casing, such as ceramic or hardened composite. The straps 641 may be arranged to substantially overlap one another in an array. A sufficient number of straps 641 are used for the anchor portion 640 to retain the bladder 630 therein as the anchor portion 640 expands.

The metal straps 641 are connected at opposite first and second ends. The strap ends may be connected by welding. The ends of the straps 641 are welded (or otherwise connected) to the upper 632 and lower 634 end connectors, respectively. The anchor portion 640 is not defined by the entire length of the straps 641; rather, the anchor portion 640 represents only that portion of the straps 641 intermediate the end connectors 632, 634 that is exposed, and can directly engage the surrounding casing. In this respect, a length of the straps 641 may be covered by a sealing cover 650.

The sealing cover 650 is placed over the bladder 630. The cover 650 is also placed over a selected length of the metal straps 641 at one end. Where a cover ring 635 is employed, the sealing cover 650 is placed over the straps 641 at the end opposite the cover ring 635. The sealing cover 650 provides a fluid seal when the packing element 605 is expanded into contact with the surrounding casing. The sealing cover 650 may be fabricated from a pliable material, such as a polymer, such as an elastomer, such as a blended nitrile base or a fluoroelastomer. An inner surface of the cover 650 may be bonded to the adjacent straps 641.

The sealing cover 650 for the packing element 600 may be uniform in thickness, both circumferentially and longitudinally. Alternatively, the sealing cover 650 may have a non-uniform thickness. For example, the thickness of the sealing cover 650 may be tapered so as to gradually increase in thickness as the cover 650 approaches the anchor portion 640. In one aspect, the taper is cut along a constant angle, such as 3 degrees. In another aspect, the thickness of the cover 650 is variable in accordance with the undulating design of Carisella, discussed in U.S. Pat. No. 6,223,820, issued May 1, 2001. The '820 Carisella patent is incorporated in its entirety herein by reference. The variable thickness cover reduces the likelihood of folding within the bladder 630 during expansion. This is because the variable thickness allows some sections of the cover 650 to expand faster than other sections, causing the overall exterior of the element 605 to expand in unison.

The cover ring 635 is optionally disposed at one end of the anchor portion 640. The cover ring 635 may be made from a pliable material, such as a polymer, such as an elastomer. The cover ring 635 serves to retain the welded metal straps 641 at one end of the anchor portion 640. The cover ring 635 typically does not serve a sealing function with the surrounding casing. The length of the cover ring may be less than the outer diameter of the packing element's running diameter.

As the bladder 630 is expanded, the exposed portion of straps 641 that define the anchor portion 640 frictionally engages the surrounding casing. Likewise, expansion of the bladder 630 also expands the sealing cover portion 650 into engagement with the surrounding bore or liner. The plug 600 is thus both frictionally and sealingly set within the casing. The minimum length of the anchor portion 640 may be defined by a mathematical formula. The anchor length 640 may be based upon the formula of two point six three multiplied by the inside diameter of the casing. The maximum length of the expanded anchor portion 640 may be less than fifty percent of the overall length of the packing element 600 upon expansion. In this regard, the anchor portion 640 does not extend beyond the center of the packing element 605 after the packing element is expanded.

Alternatively, a packing element disclosed in U.S. Pat. No. 5,495,892 issued to Cerisella which is herein incorporated by reference in their entirety may be used instead of the packing element 600. Alternatively, a solid packing element compression plug may be used instead of the inflatable plug 600.

Referring back to FIG. 1, the tool string 200 may be used to isolate and flow test multiple zones. The test may include a pressure buildup and/or a pressure drawdown test. For example, the tool string 200 may be used to test the three perforation zones 100*a-c*, shown in FIG. 1. Initially, production from all three zones may be measured to determine the total flow. Then, the tool string 200 is conveyed on the wireline 120 into the wellbore 130 such that the inflatable packer 600 is positioned between the first zone 100*a* and the second zone 100*b*, thereby isolating the first zone 100*a* from the second and third zones 100*b, c*. The string 200 may be lowered down the wellbore 130 while monitoring a signal generated by the collar locator 210 to determine a depth.

After reaching the desired location, a signal is sent from the surface to activate the inflation tool 300 and pump fluid to expand the inflatable plug 600. The current draw of the inflation tool 300 is monitored to determine the extent of inflation. For example, the current draw may be proportional to the pressure in the inflatable plug 600. The inflatable plug 600 is inflated until a predetermined pressure is reached. The inflation pressure is maintained by the one-way valve 400. Actuation of the inflatable plug 600 isolates the first zone 100*a* from the other two zones 100*b, c*. In this respect, only the flow from the second and third zones 100*b, c* is collected. The inflation tool 300 remains connected to the inflatable element during the flow test.

After flow of the second and third zones 100*b, c* has occurred for a predetermined time, the inflatable plug 600 is deflated and moved to another location. To deflate the plug 600, the wireline 120 is picked up to apply a tension force to the deflation tool 500, in this case, the pickup unloader. The tension force causes the pickup unloader 500 to open, thereby allowing deflation of the plug 600.

After deflation, the plug 600 is moved to a location between the second zone 100*b* and the third zone 100*c*. The process of actuating the plug 600 is repeated to isolate the third zone 100*c* from the remaining two zones 100*a, b*. In this respect, only flow from the third zone 100*c* is collected. After the test is run, the plug 600 may be deflated in a manner described above. From the flow data collected from the two tests and the total flow of all three zones, the flow of each zone may be calculated in a conventional manner known to a person of ordinary skill in the art. In this manner, flow testing of multiple zones may be performed in one trip.

Figure 10:
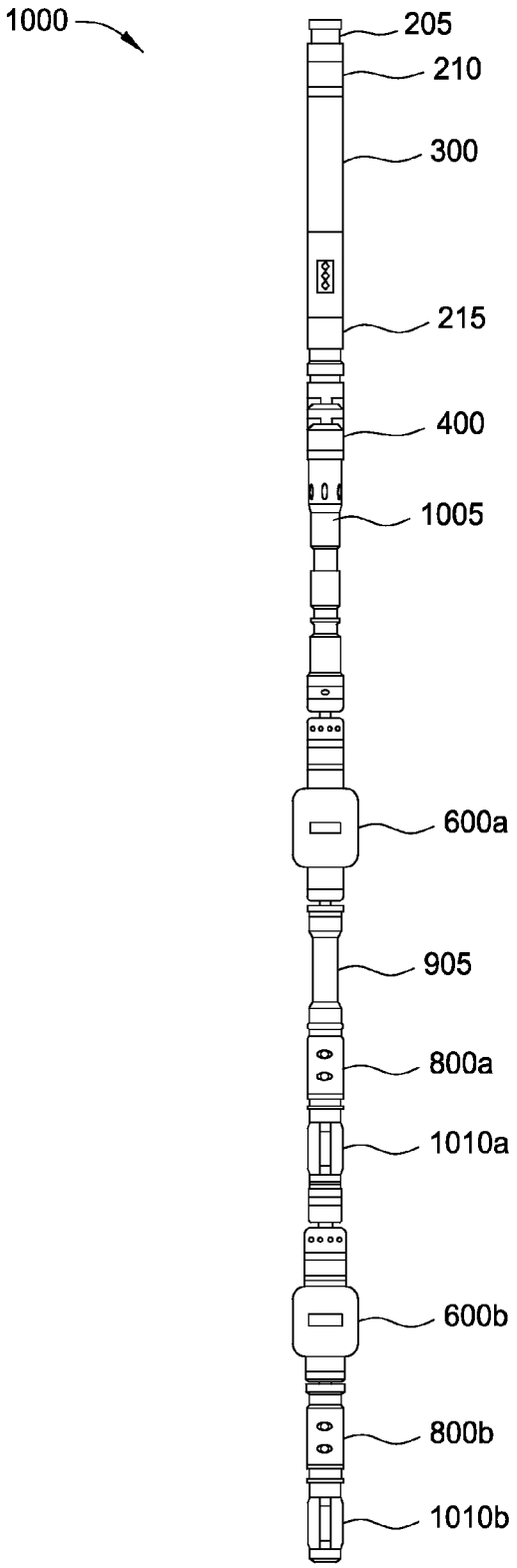
FIG. 10 illustrates a tool string, according to another embodiment of the present invention.

The tool string 200 may also include an instrumentation sub 1010 (see FIG. 10). The instrumentation sub includes a pressure sensor and a temperature sensor. The instrumentation sub may also include sensors for measuring other wellbore parameters, such as fluid density, flow rate, and/or flow hold up. The instrumentation sub may also include sensors to monitor condition of the tool string 200. For example, the instrumentation sub may include pressure and temperature sensors in communication with the inflation fluid path for monitoring performance of the inflation tool 300 and/or the plug 600. Additionally, the instrumentation sub may include a sensor for determining whether the plug has set properly (i.e., by monitoring position of the slidable sub 637). The instrumentation sub may be disposed below the plug 600 so that it may measure the effect of testing one or more zones on the isolated zone(s).

Alternatively, the instrumentation sub may be placed above the plug for measuring parameters of the zone(s) being tested. Additionally, a first instrumentation sub may be provided below the plug and a second instrumentation sub may be provided above the plug. The instrumentation sub may include a battery pack and a memory unit for storing measurements for downloading at the surface. Alternatively, the instrumentation sub may be in data communication with the wireline for real time data transfer. The instrumentation sub may be hard-wired to the wireline so that it may be powered thereby and transmit data thereto. The instrumentation sub may also communicate data to the wireline via short-hop wireless EM.

An exemplary tool string 200 equipped with sensors is disclosed in U.S. Pat. No. 6,886,631, which patent is herein incorporated by reference in its entirety. In the embodiment where the tool string 200 is lowered on a conveying member other than wireline, the sensor data may be stored in a memory connected to the probe. The stored data may be accessed after the tool string 200 is retrieved.

Additionally, the tool string 200 may include a perforation gun. The perforation gun may be used after testing of the zones 100*a-c* to further perforate any of the zones 100*a-c*. Additionally, the string 200 may be moved to a depth of a new zone and the perforation gun used to create the new zone in the same trip that the zones 100*a-c* are tested. Alternatively, the perforation gun may be used to create any one of the zones 100*a-c* prior to testing.

Figure 7:
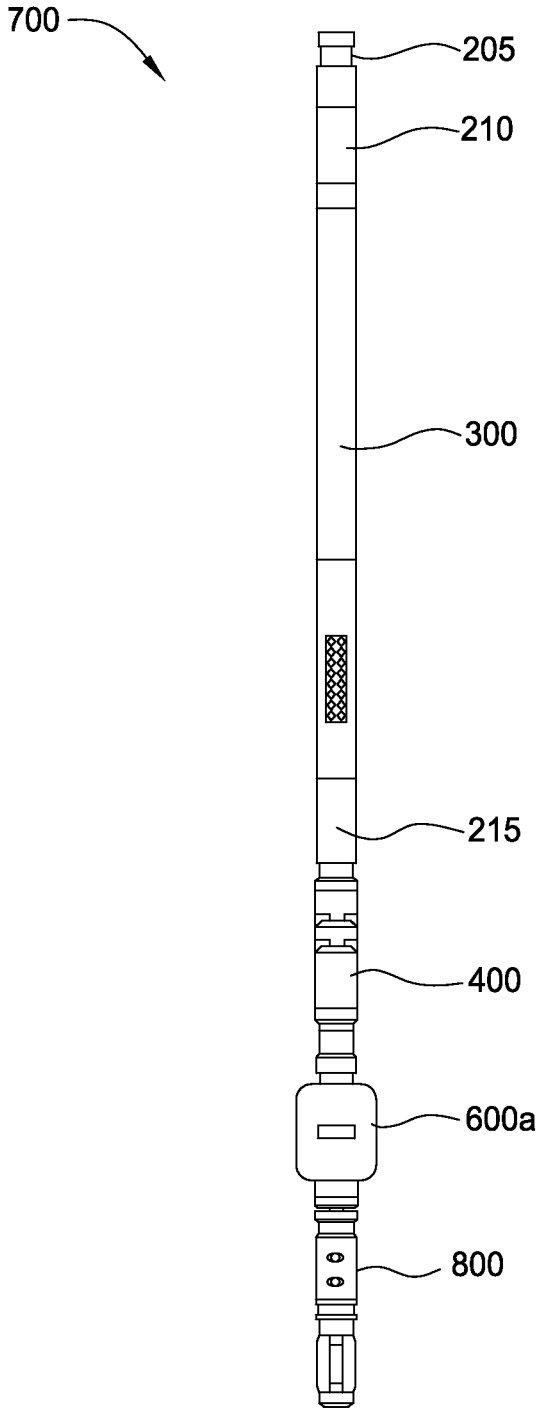
FIG. 7 illustrates a tool string, according to another embodiment of the present invention.

FIG. 7 illustrates a tool string 700, according to another embodiment of the present invention. The pickup-unloader 500 has been removed and replaced with another deflation tool, such as an electronic shut-in tool (ESIT) 800. To facilitate placement of the ESIT, the plug 600 has been replaced by a packer 600*a*. The ESIT 800 may be connected to a lower portion of the inflatable packer 600*a* and in fluid communication therewith. The packer may be identical to the plug 600 except for replacement of the nose 665 with a coupling for connection to the ESIT 800. Additionally, the pickup unloader 500 may be used in the string 700 as a backup for the ESIT 800.

Figure 8:
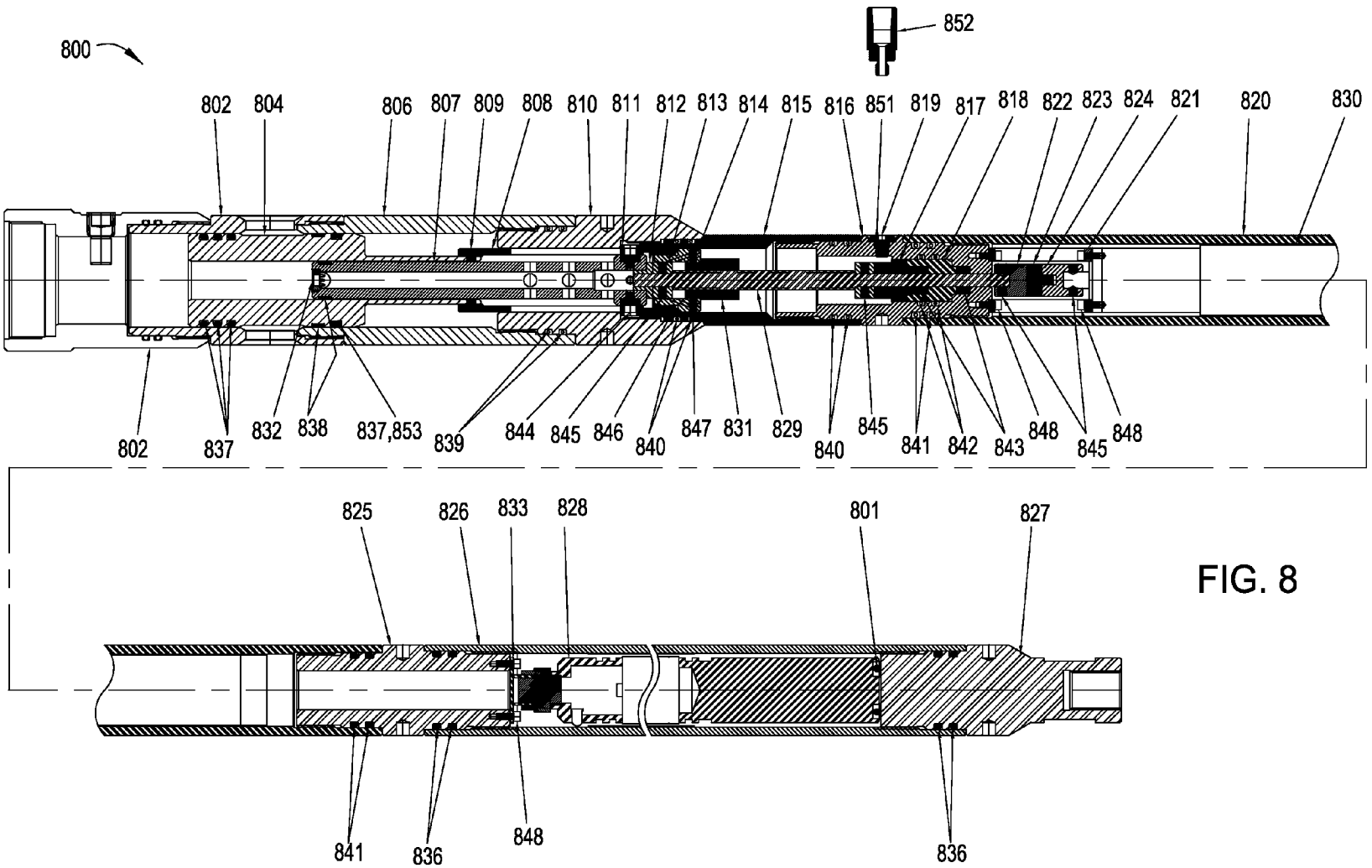
FIG. 8 is a cross section of a deflation tool suitable for use with the tool string.

FIG. 8 is a cross section of the ESIT 800. The ESIT may include an O-ring 801, an upper valve housing 802, a valve sleeve 804, a lower valve housing 806, a piston housing 807, a valve operator 808, a shear pin 809, a top sub 810, a head retainer 811, a thrust bearing 812, a boss 813, a nut connector 814, a drive housing 815, a motor crossover 816, a lower thrust bearing 817, a thrust sub 818, a grease plug 819, a motor housing 820, a motor bracket 821, a coupling 822, a coupling link 823, a shaft coupling 824, a battery crossover 825, a battery housing 826, a bottom sub 827, a battery pack 828, a drive shaft 829, an electric motor and electronics assembly 830, a nut 831, a filter 832, a connector 833, one or more O-rings 836, one or more O-rings 837, a wear strip 838, one or more O-rings 839, one or more O-rings 840, one or more O-rings 841, one or more O-rings 842, a longitudinal pressure seal 843, a cap screw 844, a set screw 845, a set screw 846, a set screw 847, a cap screw 848, an O-ring 851, a grease fitting 852, and a back up ring 853.

The electronics 830 may include a memory and a controller having any suitable control circuitry, such as any combination of microprocessors, crystal oscillators and solid state logic circuits. The controller may include any suitable interface circuitry such as any combination of multiplexing circuits, signal conditioning circuits (filters, amplifier circuits, etc.), and analog to digital (A/D) converter circuits. In use, the ESIT 800 may be preprogrammed with the desired open and close intervals, for example, open for 30 minutes and close for 12 hours. When the ESIT 800 is open, the packer 600*a* will be allowed to deflate. When the ESIT 800 is closed, the packer 600*a* will be allowed to inflate, for example, by the inflation tool 300. The preprogrammed intervals will allow the tool assembly 200 to be repositioned at another zone for testing.

The valve sleeve 804 is longitudinally movable relative to a housing assembly 802, 806, 810, 815, 820, 825, 827 by operation of the motor 830. The valve sleeve 804 is movable between a closed position (as shown) where a wall of the valve sleeve covers one or more flow ports formed through a wall of the upper valve housing 802. A shaft of the motor 830 is rotationally coupled to the drive shaft 829 via the couplings 822-824. A portion of the drive shaft 829 has a thread formed on an outer surface thereof. The nut 831 is engaged with the threaded portion of the drive shaft 829. Rotation of the drive shaft 829 by the motor 830 translates the nut 831 longitudinally. The nut 831 is longitudinally coupled to the valve operator 808. The valve operator has one or more slots formed through a wall thereof. A respective head retainer 811 is disposed through each of the slots. Each head retainer is longitudinally coupled to the housing assembly. In the closed position, each head retainer engages an end of the slot. The valve operator is longitudinally coupled to the valve sleeve 804. Thus, rotation of the motor shaft moves the valve sleeve 804 longitudinally relative to the housing assembly from the closed position to the open position where the valve sleeve openings are in fluid communication with a bore of the upper valve housing 802 and thus the packer. In the open position, each head retainer engages the other end of the respective slot.

A bore formed through the valve sleeve 804 is in fluid communication with the upper valve housing bore. The valve sleeve 804 is also in filtered 832 fluid communication with a bore formed through the piston housing 807. One or more ports are formed through a wall of the piston housing 807. The ports provide fluid communication between the piston housing bore and a bore formed through the valve operator. The slots formed through the valve operator provide fluid communication between the valve operator bore and a clearance defined between the valve operator and the top sub 810. The clearance provides fluid communication between the valve operator bore and a chamber formed between valve sleeve 804 and the valve housing 806. This fluid path keeps a first longitudinal end of the valve sleeve equalized with a second end of the valve sleeve so that the motor 830 does not have to overcome fluid force. Alternatively, the ESIT 800 may be in communication with the wireline for receiving power and/or control signals.

Figure 9:
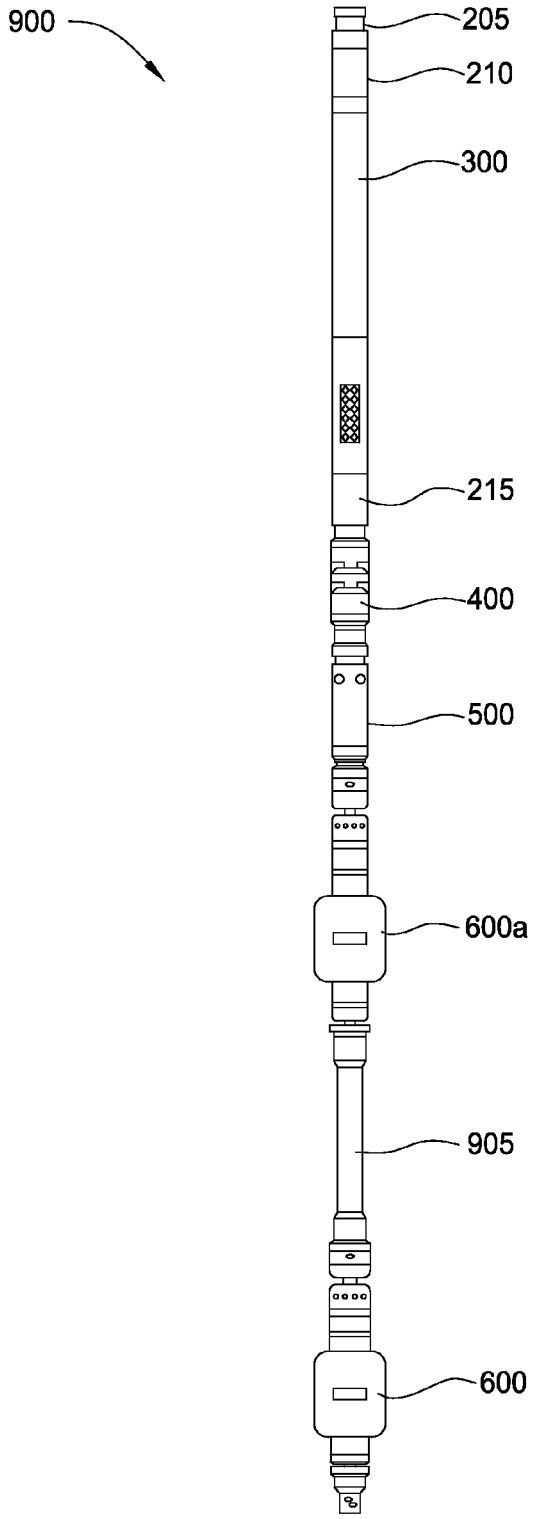
FIG. 9 illustrates a tool string, according to another embodiment of the present invention.

FIG. 9 illustrates a tool string 900, according to another embodiment of the present invention. The tool string 900 includes the packer 600*a* and the plug 600 separated by a spacer pipe 905. Alternatively, the plug may be replaced by a second packer so that the ESIT 800 may be used instead of the pickup unloader 500. In use, the packer and plug may be actuated to straddle a zone of interest. During testing, the zone(s) above the packer 600*a* may be monitored for the production flow. The zone between the plug and the packer may be monitored for pressure changes caused by flowing the zone above the packer. The collected pressure data may be used to further determine the potential of the formation. It must be noted that the zones may be monitored for temperature, fluid density, or other desired parameters.

Alternatively, the plug may be replaced by a second packer and the tool string 900 may include a bypass flow path having an inlet below the second packer and an outlet above the packer 600*a*. In this manner, zones 100*b, c* may be isolated while zone 100*a* is tested. The bypass flow path may be within the packers, i.e. through the bores, and the inflation path may be through the annuluses. Alternatively, tubing may be added to provide the inflation path from the inflation tool 300 to the packer and the plug.

Additionally, the tool string 900 may include a perforation gun. The perforation gun may be used after testing of the zones 100*a-c* to further perforate any of the zones 100*a-c*. Additionally, the string 900 may be moved to a depth of a new zone and the perforation gun used to create the new zone in the same trip that the zones 100*a-c* are tested. Alternatively, the perforation gun may be used to create any one of the zones 100*a-c* prior to testing.

FIG. 10 illustrates a tool string 1000, according to another embodiment of the present invention. The tool string 1000 includes a production logging tester (PLT) 1005, two ESITs 800*a, b*, and two instrumentation subs 1010*a, b*. The PLT 1005 includes a flow meter. The flow meter may be a simple single phase meter or a multiphase (i.e., gas, oil, and water) meter. The flow meter may be as simple as a spinner or as complex as a Venturi with a gamma ray tool and pressure and temperature sensors to measure flow rates of individual phases. For the more complex flow meters, the instrumentation sub 1010*a* may be omitted if it is redundant.

The tool string 1000 may straddle and test each of the zones 100*a-c* individually. For example, the packers 600*a,b* may be inflated adjacent zone 100*b* to straddle the zone. The ESIT 800*a* port opens to allow production fluid into the bypass path. The production fluid travels along the bypass path to the PLT 1005 which measures the flow rate of the fluid. The fluid exits the PLT 1005 and comingles with the fluid from zone 100*c*. The data from the PLT 1005 may be stored in a memory unit or transmitted to the surface in real time. The packers may then be deflated using the second ESIT 800*b*. The tool string 1000 may then be moved to the next zone of interest and the sequence repeated.

Further, the tool string 1000 provides for collection of the flow test data in the wellbore 130 instead of at the surface. In this manner, any transient flow pattern (i.e., slugging) may be measured before the flow pattern changes while flowing to the surface.

Alternatively, the second ESIT 800*b* may be in fluid communication with the bypass path instead of the inflation path. This alternative would allow for individually testing the straddled zone 100*b* by opening the ESIT 800*a* and then individually testing the zone 100*a* below the second packer 600*b* by closing the ESIT 800*a* and opening the ESIT 800*b*. The order may be reversed. This alternative may include a pickup unloader or an additional ESIT to deflate the packers 600*a, b*.

Alternatively, the packer 600*b* and instrumentation sub 1010*b* may be omitted. This alternative would be analogous to the tool string 200 but would provide for the collection of data in the wellbore.

Additionally, the tool string 1000 may include a perforation gun. The perforation gun may be used after testing of the zones 100*a-c* to further perforate any of the zones 100*a-c*. Additionally, the string 1000 may be moved to a depth of a new zone and the perforation gun used to create the new zone in the same trip that the zones 100*a-c* are tested. Alternatively, the perforation gun may be used to create any one of the zones 100*a-c* prior to testing.

Figure 11:
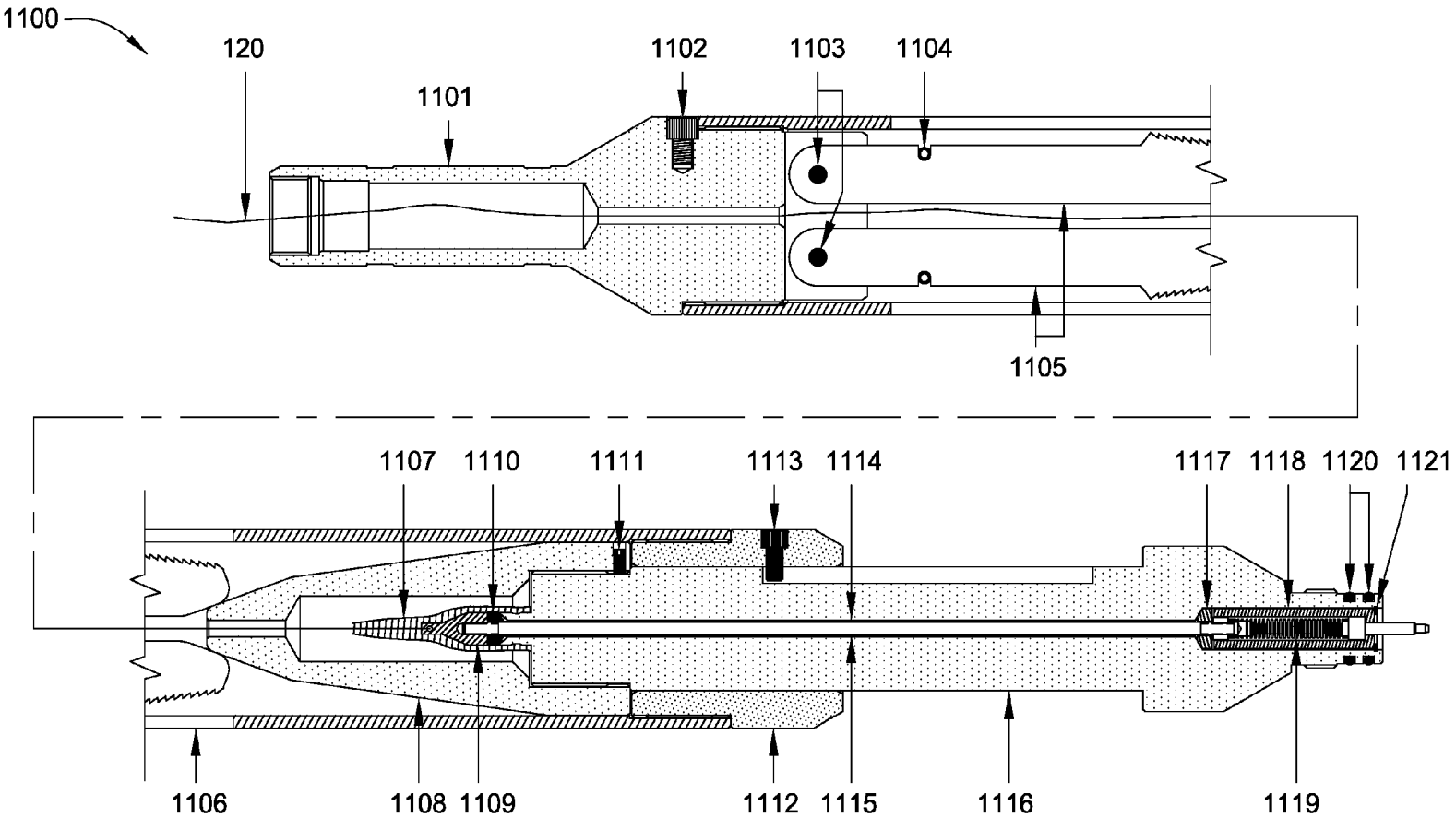
FIG. 11 illustrates an anti-blowup device or brake suitable for use with any of the tool strings, according to another embodiment of the present invention.

FIG. 11 illustrates an anti-blowup device or brake 1100, according to another embodiment of the present invention. The brake 1100 may be disposed in any of the tool strings 200, 700, 900, 1000. The brake 1100 is operable to prevent the tool assembly from being blown toward the surface in the event that a pressure differential develops across the tool assembly while the packer(s)/plug is not set (i.e., loss of pressure control at the surface) or the packer(s)/plug fails. The brake 1100 may be positioned at or near an end of the tool assembly proximate to the wireline. The brake 1100 may include a top sub 1101, a cap screw 1102, a plurality of pins 1103, a spring 1104, a plurality of anchor legs or dogs 1105, a housing 1106, an insulating material 1107, a cone 1108, a nut 1109, an insulator 1110, a set screw 1111, a guide 1112, a cap screw 1113, an insulator 1114, a contact rod 1115, a slack joint 1116, an insulator 1117, a contact plunger 1118, a contact assembly 1119, an O-ring 1120, and a retaining ring 1121.

Should the tool assembly begin to accelerate toward the surface due to a loss of pressure control, the slack joint and cone 1108, which are longitudinally coupled to the rest of the tool assembly, move relative to the dogs 1105, which are pivoted to the housing 1106. The inertia and weight of the housing, top sub, and dogs 1105 retains them longitudinally. The dogs are pushed radially outward through respective openings in a wall of the housing and into engagement with the casing by sliding of inner surfaces thereof along the cone. The outward movement of the dogs also extends the spring 1104. The outward movement continues until the cap screw engages an end of a slot formed in an outer surface of the slack joint 1116. Engagement of the slack joint with the guide 1112, which is longitudinally coupled to the housing, which is now secured to the casing, halts acceleration of the tool assembly toward the surface. Once pressure control has been regained, the weight of the tool assembly will pull the cone and slack joint longitudinally until the cap screw 1113 engages the other end of the slack joint slot while the spring retracts the dogs radially inward.

In another embodiment, the tool strings 200, 700, 900 & 1000 with one or more perforation guns included may be used open up a new zone for production or to shoot additional perforations within an existing production zone.

In the case that additional perforations are to be made within an existing production zone, the method may involve the steps of running into a wellbore a tool string 200, 700, 900 & 1000 with one or more perforation guns included, then setting the packer(s) and/or plug(s) (as appropriate to the tool string configuration 200, 700, 900 or 1000) and flow testing the desired zone, then detonating the perforating guns and then flow testing the desired zone again. Additionally or alternatively, the packer(s) and/or plug(s) may be unset prior to detonating the perforating guns. Additionally, the tool string may be moved to reposition the perforating guns at a desired depth prior to detonating the perforating guns. Additionally, the packer(s) and/or plug(s) may be reset prior to detonating the perforating guns. Alternatively, the packer(s) and/or plug(s) may be reset after detonating the perforating guns.

If there is a zone already open for flow separate from the zone to be perforated, the method may include the step of testing the production from the already open zone prior to shooting perforations into the new zone.

The brake 1100 may be useful in this embodiment as the tool string(s) may be susceptible to being blown up the wellbore upon detonation of the perforating gun.

Furthermore, this embodiment would be conducted in a single trip into the wellbore.

In another embodiment, any of the tool assemblies 200, 700, 900, 1000 may be lowered down the wellbore 130 on a conveying member other than a wireline 120 (e.g., COROD®, slickline, or optical fiber). In such embodiments, the tool assembly 110 may include a battery to power the inflation tool 300 and a trigger device to actuate the inflation tool 300. Still further, the assembly 110 may be configured to operate autonomously (i.e., without surface intervention) after receiving a triggering signal from a triggering device which may supply power to the inflation tool 300 from the battery. The triggering device may generate trigger signal upon the occurrence of predetermined trigger conditions. For example, the triggering device may monitor an output of the casing collar locator 210 to determine depth or an output of a temperature or pressure sensor. Exemplary operating tools deployed on conveying members other than wireline is described in U.S. Pat. No. 6,945,330, which patent is hereby incorporated by reference in its entirety. In yet another embodiment, the tool assembly may include a tractor to facilitate movement through the wellbore.

In another embodiment, the plugs and/or packers of any of the tool strings 200, 700, 900, 1000 may remain in the wellbore to isolate a zone of interest after the flow test is performed. In this respect, the inflatable element may be separated from the tool assembly and remain in the wellbore either temporarily or permanently.

In yet another embodiment, although the inflation tool and the deflation tool are discussed as separate tool, it is contemplated that the tools may be integrated as a single tool.

In yet another embodiment, any of the tool strings 200, 700, 900, and 1000 may also be used to inject a treatment fluid. For example, after the inflatable plug/packer is activated, a wellbore treatment fluid such as a fracturing fluid or other chemical fluid may be injected into the zone of interest. The treatment process and the flow test may be performed in the same trip.

Embodiments of the present invention are especially useful for deployment from off-shore rigs where rig time and rig space are at a premium. Alternatively, embodiments of the present invention are useful for land-based rigs as well. Embodiments of the present invention are useful for vertical and deviated (including horizontal) wellbores.

While the foregoing is directed to embodiments of the present invention, other and further embodiments of the invention may be devised without departing from the basic scope thereof, and the scope thereof is determined by the claims that follow.

The invention claimed is:

1. A method of flow testing multiple zones in a wellbore, comprising:
- lowering a tool string into the wellbore, the tool string comprising:
  - a plurality of inflatable packers, and
  - a pump comprising:
    - a pressure balanced closed working fluid system having a working fluid pump and an electric motor operable to drive the working fluid pump, and
    - a reciprocating hydraulic pump having a drive piston in selective fluid communication with the working fluid pump and a pump piston in selective fluid communication with the wellbore and the packers;
- inflating the packers by operating the pump, thereby straddling a first zone; and
- while the first zone is straddled:
  - measuring a flow rate from the first zone; and
  - measuring a flow rate from a second zone located between a lower packer and the bottom of the wellbore.

2. The method of claim 1, wherein the tool string is lowered into the wellbore on a wireline coupled thereto.

3. The method of claim 2, wherein:
- the tool string further comprises a deflation tool, and the packers are deflated by operating the deflation tool.

4. The method of claim 3, the deflation tool is operated by exerting tension on the wireline.

5. The method of claim 3, wherein:
- the deflation tool comprises a valve and an electronic actuator, and
- the packers are deflated by the electronic actuator opening the valve.

6. The method of claim 2, further comprising reporting the measurements to surface in real time using the wireline.

7. The method of claim 1, wherein:
- the tool string further comprises a flow meter, and
- the flow rates from the first and second zones are measured with the flow meter.

8. The method of claim 7, wherein the flow meter is a single phase meter or a multiphase meter.

9. The method of claim 7, wherein the flow meter comprises a spinner, a Venturi, a pressure sensor, or combinations thereof.

10. The method of claim 7, wherein the tool string further comprises:
- an upper valve disposed between the packers and operable to selectively provide fluid communication between the wellbore and the flow meter, and
- a lower valve disposed below a lower one of the packers and operable to selectively provide fluid communication between the wellbore and the flow meter.

11. The method of claim 3, wherein the tool string further comprises a one-way valve configured to maintain inflation of the packers and positioned between the electric pump and the deflation tool.

12. The method of claim 1, wherein:
- the tool string further comprises an instrumentation sub, and
- the method further comprises measuring a temperature and pressure of wellbore fluid.

13. The method of claim 1, further comprising measuring the flow rate from a combination of the first zone, the second zone, and a third zone, and calculating the flow rate of the third zone based on measurements of the first zone, second zone, and the combination of the first, second, and third zones.

14. The method of claim 1, wherein the wellbore has been cased and cemented.

15. The method of claim 1, further comprising lowering the tool string through a production tubing positioned at an upper end of the wellbore and extending into the wellbore.

16. The method of claim 1, further comprising perforating a production zone on the same trip.

17. The method of claim 1, wherein the tool string further comprises an anti-blowup device.

18. The method of claim 1, further comprising injecting a wellbore treating fluid on the same trip.

19. A tool string for flow testing multiple zones in a wellbore, comprising:

an inflatable packer or plug;

an electric pump operable to inflate the packer or plug and comprising:

a pressure balanced closed working fluid system having a working fluid pump and an electric motor operable to drive the working fluid pump, and a reciprocating hydraulic pump having a drive piston for selective fluid communication with the working fluid pump and a pump piston for selective fluid communication with the wellbore and the packer or plug; and a deflation tool operable to deflate the packer or plug in an open position, wherein:

the deflation tool is repeatably operable between the open position and a closed position, and the tool string is tubular.

20. The tool string of claim 19, further comprising a flow meter.

21. The tool string of claim 19, further comprising a wireline cable head.

22. The tool string of claim 19, further comprising a second inflatable packer or plug.

23. The tool string of claim 19, further comprising a perforation gun.

24. The tool string of claim 22, further comprising:

an upper valve disposed between the packers or plugs and operable to selectively provide fluid communication between the wellbore and the flow meter; and a lower valve disposed below a lower one of the packers or plugs and operable to selectively provide fluid communication between the wellbore and the flow meter.

25. A tool string for flow testing multiple zones in a wellbore, comprising:

a wireline cable head;

upper and lower inflatable packers;

an electric pump operable to inflate the packers;

a deflation tool operable to deflate the packers;

a flow meter;

an upper valve disposed between the packers and operable to selectively provide fluid communication between the wellbore and the flow meter; and a lower valve disposed below the lower packer and operable to selectively provide fluid communication between the wellbore and the flow meter, wherein the tool string is tubular.

26. The tool string of claim 25, wherein the upper valve and the lower valve are electronic shut-in tools.

27. The tool string of claim 25, wherein the pump comprises:

a pressure balanced closed working fluid system having a working fluid pump and an electric motor operable to drive the working fluid pump, and a reciprocating hydraulic pump having a drive piston in selective fluid communication with the working fluid pump and a pump piston in selective fluid communication with the wellbore and the packers.

28. A method of flow testing multiple zones in a wellbore, comprising:

lowering a tool string into the wellbore, the tool string comprising:

a plurality of inflatable packers, and a pump, a flow meter, an upper valve disposed between the packers and operable to selectively provide fluid communication between the wellbore and the flow meter, and a lower valve disposed below a lower one of the packers and operable to selectively provide fluid communication between the wellbore and the flow meter;

inflating the packers by operating the pump, thereby straddling a first zone; and while the first zone is straddled:

measuring a flow rate from the first zone using the flow meter; and measuring a flow rate from a second zone located between a lower packer and the bottom of the wellbore using the flow meter.

* * * * *